US007817038B2

(12) United States Patent
Tørning

(10) Patent No.: US 7,817,038 B2
(45) Date of Patent: Oct. 19, 2010

(54) OBJECT DETECTION FRAMEWORK FOR SET OF RELATED OBJECTS

(75) Inventor: Kristian Tørning, København (DK)

(73) Assignee: Microsoft Corporation, Redmond, WA (US)

( * ) Notice: Subject to any disclaimer, the term of this patent is extended or adjusted under 35 U.S.C. 154(b) by 911 days.

(21) Appl. No.: 11/625,548

(22) Filed: Jan. 22, 2007

(65) Prior Publication Data

US 2008/0174425 A1 Jul. 24, 2008

(51) Int. Cl.
*G08B 13/14* (2006.01)

(52) U.S. Cl. ..... 340/572.1; 340/539.12; 340/539.21; 340/539.22; 340/539.23; 340/539.32; 340/568.1; 340/572.2; 340/686.1; 340/686.6

(58) Field of Classification Search ..... 340/572.1, 340/539.1, 539.21, 539.23, 539.11, 539.13, 340/686.1, 686.6, 568.1, 539.32, 573.1, 539.22, 340/572.2

See application file for complete search history.

(56) References Cited

U.S. PATENT DOCUMENTS

| | | | | |
|---|---|---|---|---|
| 4,675,656 | A | 6/1987 | Narcisse | |
| 4,785,291 | A | 11/1988 | Hawthorne | |
| 5,583,488 | A | 12/1996 | Sala et al. | |
| 5,661,460 | A | 8/1997 | Sallen et al. | |
| 5,844,489 | A | 12/1998 | Yarnall, Jr. et al. | |
| 5,868,100 | A * | 2/1999 | Marsh | 119/421 |
| 5,939,988 | A | 8/1999 | Neyhart | |
| 6,232,880 | B1 * | 5/2001 | Anderson et al. | 340/573.3 |
| 6,304,186 | B1 | 10/2001 | Rabanne et al. | |
| 6,331,817 | B1 * | 12/2001 | Goldberg | 340/573.1 |
| 6,515,588 | B1 * | 2/2003 | Sarabia | 340/568.1 |
| 6,674,364 | B1 * | 1/2004 | Holbrook et al. | 340/568.1 |
| 6,747,555 | B2 * | 6/2004 | Fellenstein et al. | 340/524 |
| 6,847,295 | B1 * | 1/2005 | Taliaferro et al. | 340/539.13 |
| 7,010,369 | B2 | 3/2006 | Borders et al. | |
| 7,015,812 | B1 | 3/2006 | Lemchen | |
| 7,034,684 | B2 * | 4/2006 | Boman et al. | 340/568.1 |
| 7,039,547 | B2 | 5/2006 | Wilson | |
| 7,323,988 | B2 * | 1/2008 | Krstulich | 340/572.1 |
| 7,327,251 | B2 * | 2/2008 | Corbett, Jr. | 340/539.13 |
| 7,518,514 | B2 * | 4/2009 | Bauchot et al. | 340/572.1 |
| 7,538,670 | B2 * | 5/2009 | Smith et al. | 340/539.26 |
| 2005/0065720 | A1 | 3/2005 | Lewis et al. | |

OTHER PUBLICATIONS

G. Borriello, et al., "Reminding About Tagged Objects Using Passive RFIDs," Proc. Ubicomp 2004, pp. 36-53. http://www.uwnews.org/relatedcontent/2004/October/rc_parentID5748_thisID5749.pdf.

(Continued)

*Primary Examiner*—Davetta W Goins
(74) *Attorney, Agent, or Firm*—Perkins Coie LLP

(57) ABSTRACT

An object detection framework enables the definition of a set of related physical objects, and provides a corresponding ability to detect when one or more of the objects disassociates from the set. Object relationships within a set can be defined, and disassociation is detected when one or more of the object relationships no longer holds true, such as when one of the objects is no longer within a threshold proximity of the other objects of the set. Then, one or more responses, such as an alert, are automatically initiated in response to the disassociation. In various non-limiting implementations of the framework, each object of a related set is provisioned with the ability to any one or more of emit, detect and/or transmit detection information, process and/or store detection information, or initiate response(s) to detection information.

19 Claims, 19 Drawing Sheets

OTHER PUBLICATIONS

A. Masters, et al., "Humancentric Applications of RFID Implants: The Usability Contexts of Control, Convenience and Care," Faculty of Informatics. Faculty of Informatics—Papers. University of Wollongong. Year 2005, http://ro.uow.edu.au/cgi/viewcontent.cgi?article=1248&context=infopapers.

Nathan Eagle and Alex Pentland, "Social Serendipity: Proximity Sensing and Cueing," MIT Media Laboratory Technical Note 580, May 2004. http://www.cc.gatech.edu/ccg/paper_of_week/socialserendipity.pdf.

* cited by examiner

OBJECT DETECTION FRAMEWORK FOR SET OF RELATED OBJECTS

TECHNICAL FIELD

The subject disclosure relates to a general framework for detecting disassociation of one or more physical objects from a set of related objects.

BACKGROUND

For typical real world objects, it is difficult to ascertain whether an object is "lost" from a set of other objects with which the object is associated, or from which the object should otherwise not be separated. As a simple example, consider a 1000 piece jigsaw puzzle—all of the pieces of the jigsaw puzzle should remain together lest the completed jigsaw puzzle will be incomplete. Without counting the pieces by hand, which is error prone, or going through the exhaustive exercise of piecing together the entire puzzle to see where any hole(s) are, which is time consuming, it is practically impossible to detect a missing puzzle piece from a box full of 999 puzzle pieces that should have 1000.

Even where a person might exhaustively count the 999 puzzle pieces, and deduce that one puzzle piece is missing from the 1000 piece jigsaw puzzle, gaining knowledge of the mere fact that there is a missing puzzle piece is not enough information. For instance, this information alone will not help the person determine what the exact graphic on the missing piece is, when the missing piece was lost, where the missing piece was lost, or to what other pieces the missing piece connects.

Thus, even if the loss of the object is discoverable, more information about the loss would be desirable, such as what the exact nature of the lost object is, when the loss occurred, where the loss occurred, and/or to what other objects the lost object is associated. Today, however, there is no known system that can analyze loss of object(s) in a generalized context aware manner for any pre-associated set of objects and ascertain this kind of information.

There are existing systems that independently detect the presence of items of a set of items within a pre-defined physical space, i.e., systems that can determine whether any of a pre-defined set of items has left the pre-defined physical space. These systems are utilized, for instance, in libraries where detectors are arranged at exits to determine whether any books are leaving the library in an unauthorized manner. These systems have also been applied in the security context, e.g., applied to a safe where a user must explicitly check items in and out of the safe, and the safe operates to interrogate its interior to determine whether the contents are proper. Similar systems have been applied at delivery checkpoints to determine whether any items are missing inside a given truck storage compartment upon arrival of a given truck to a given delivery checkpoint.

However, existing systems are inherently constrained by the 3-D space in which they are implemented. For instance, in the library example, the four corners of the library define the limited 3-D space in which the system operates. Once a book leaves the four corners of the library, the system can determine nothing further about the book. In this sense, such systems are custom tailored solutions for a particular space in that they cannot be used outside of their defined operational space, unless physically moved and installed at a new space (in which case, the system is then constrained to the new space).

Another problem is that existing object detection systems operate on an item-by-item basis without any appreciation of item association. For instance, suppose Volume I and Volume II of an ancient text are taken from a library. While existing systems can determine that Volume I is missing, and independently, that Volume II is missing, there is no certainty as to whether Volume I and II are still together after leaving the library. Once again, no further information about the books can be ascertained. All that is known to such a system is that two independently identified books have left the library in an unauthorized manner.

Accordingly, it would be desirable to provide a generalized framework for any pre-defined set of objects for detecting the disassociation, or loss, of any one or more objects from the pre-defined set. It would be further desirable to provide a general framework that detects such disassociation without being constrained to a pre-defined operating space. It would be still further desirable to provide a framework for detecting disassociation among a group of objects that automatically responds appropriately given the context of the group of objects.

These and other deficiencies in the state of the art of object detection will become apparent upon description of the various exemplary non-limiting embodiments of the invention set forth in more detail below.

SUMMARY

An object detection framework enables the definition of a set of related physical objects, and provides a corresponding ability to detect when one or more of the objects disassociates from the set. Object relationships within a set can be defined, and a disassociation event is detected when one or more of the object relationships no longer holds true, such as when one of the objects is no longer within a threshold proximity of the other objects of the set. Then, one or more responses can be automatically initiated in response to the disassociation event, including, but not limited to, generating an alert or transmitting the event to a networked application or service. In various non-limiting implementations, each object of a related set is provisioned with electronic, chemical or biological components that any one or more of emit, detect and/or transmit detection information in order to detect disassociation of an object from the related set, and optionally, to initiate response(s) as a result. In addition, each object can be provisioned to process and/or store detection information.

A simplified summary is provided herein to help enable a basic or general understanding of various aspects of exemplary, non-limiting embodiments that follow in the more detailed description and the accompanying drawings. This summary is not intended, however, as an extensive or exhaustive overview. The sole purpose of this summary is to present some concepts related to the various exemplary non-limiting embodiments of the invention in a simplified form as a prelude to the more detailed description that follows.

BRIEF DESCRIPTION OF THE DRAWINGS

The system and methods for detecting disassociation of object(s) from a set of related objects are further described with reference to the accompanying drawings in which.

DETAILED DESCRIPTION

Overview

In consideration of the various limitations of existing systems for detecting objects, e.g., as discussed in the background, the invention provides a generalized framework that applies to any pre-defined set of objects for detecting the disassociation, or loss, of any one or more objects from the pre-defined set. Advantageously, the framework is applicable to a set of related objects wherever the set of objects may be located, independent of physical space or location, to help detect disassociation of any one or more of the object(s) from the rest of the set wherever located. In various non-limiting embodiments, upon detection of disassociation of an object from its set, one or more pre-defined responses or actions are automatically initiated for the given disassociation context.

These and other non-limiting aspects of various embodiments of the invention are described in more detail below.

Detection of Disassociation of Object(s) from a Set

Generally speaking, there are countless circumstances when various like or unlike items are supposed to be together, and not supposed to separate without notice. In this regard, while specific scenarios might be discussed herein for concreteness, the general framework of the invention advantageously applies to any of such circumstances, i.e., whenever any set of objects should stay together.

Figure 1:
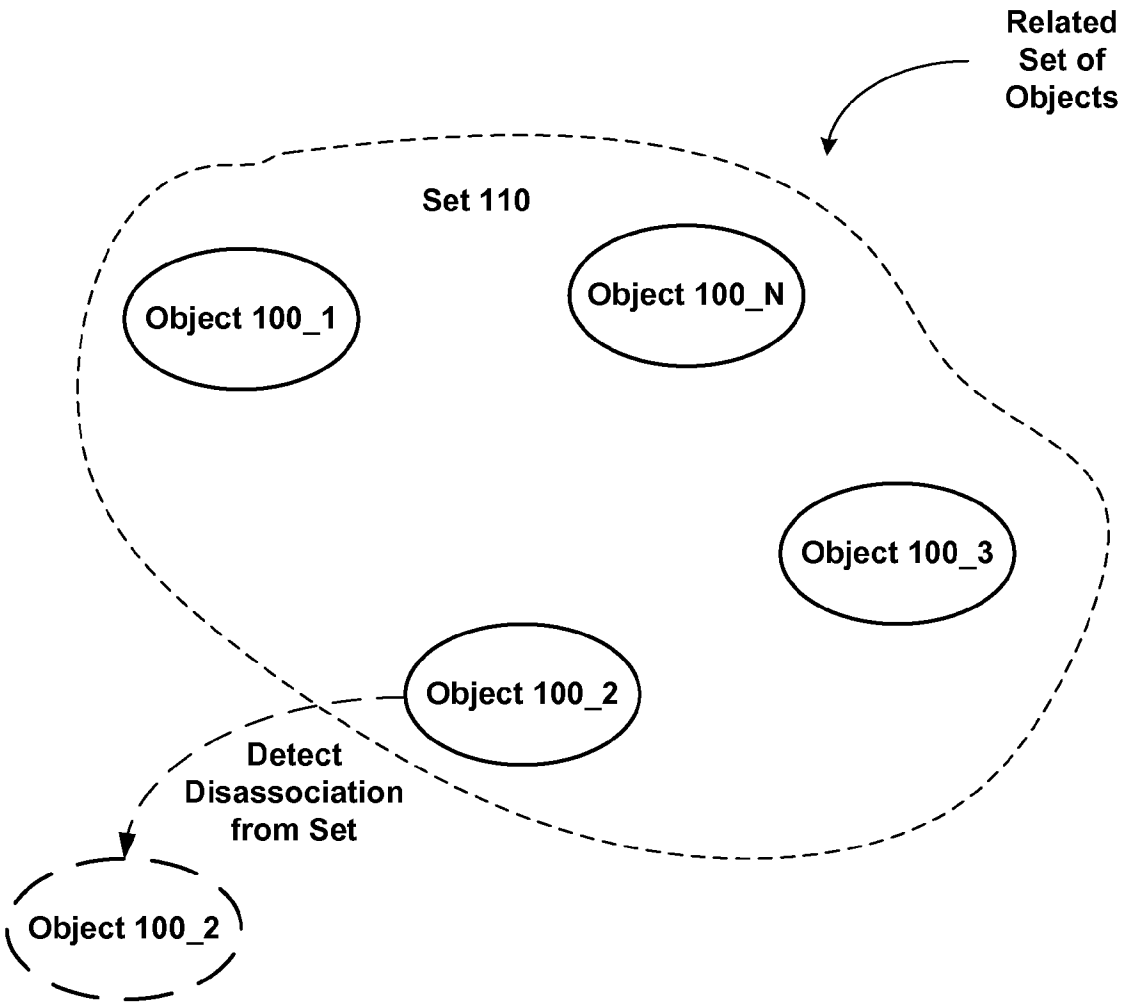
FIG. 1 generally illustrates disassociation of an object from a set of related objects in accordance with the invention.

As illustrated in FIG. 1, at a high level, the invention detects disassociation of one or more objects, such as object 100_2, from a related set 110 of N objects, such as object 100_1, 100_2, 100_3, . . . , 100_N. Set 110 is illustrated with dashed lines because there is no physical constraint placed on the location of the set of objects as with systems in the past, i.e., wherever in physical space set 110 happens to be, the invention operates to detect when an object disassociates (e.g., becomes separated) from the set of objects.

In various non-limiting embodiments described herein, the invention enables context aware proximity detection and optional alert. In such non-limiting embodiments, a threshold distance (or other measure of proximity, such as signal strength) is used to determine whether one or more objects have become disassociated from the group, and if so, optional action, such as an alert, can be taken.

For a simple example, suppose a person always needs to bring their door key, car keys and wallet wherever they go. In such case, with the framework of the invention, the person can associate the items as a group, and then define that none of the items should ever be separated by a pre-determined distance, e.g., 50 cm, or some other measure of proximity, lest an alarm should sound. Then, once setup, if any of the items from the group disassociate, which in this case is defined as any one item being farther from any other item by 50 cm, then some action(s) can be taken.

For instance, a nearby person can be notified of the disassociation by an alarm, other sound, vibration, light, smell, etc., immediately. For example, each object can be provisioned with a micro-alarm, light emitting diodes (LEDs), piezoelectric vibration motors, odor-producing agents, etc. As a result, the person immediately becomes aware of the issue that any of the wallet, door key, and car keys have disassociated from the group before the person goes too far. Consequently, rather than leaving the person's wallet on the cashier counter at a store and walking away, only to discover the missing wallet at home, the person will immediately become aware of the issue, and recover the wallet (once again re-associating the object with the set of objects by bringing it back within 50 cm of the other two objects).

Figure 2:
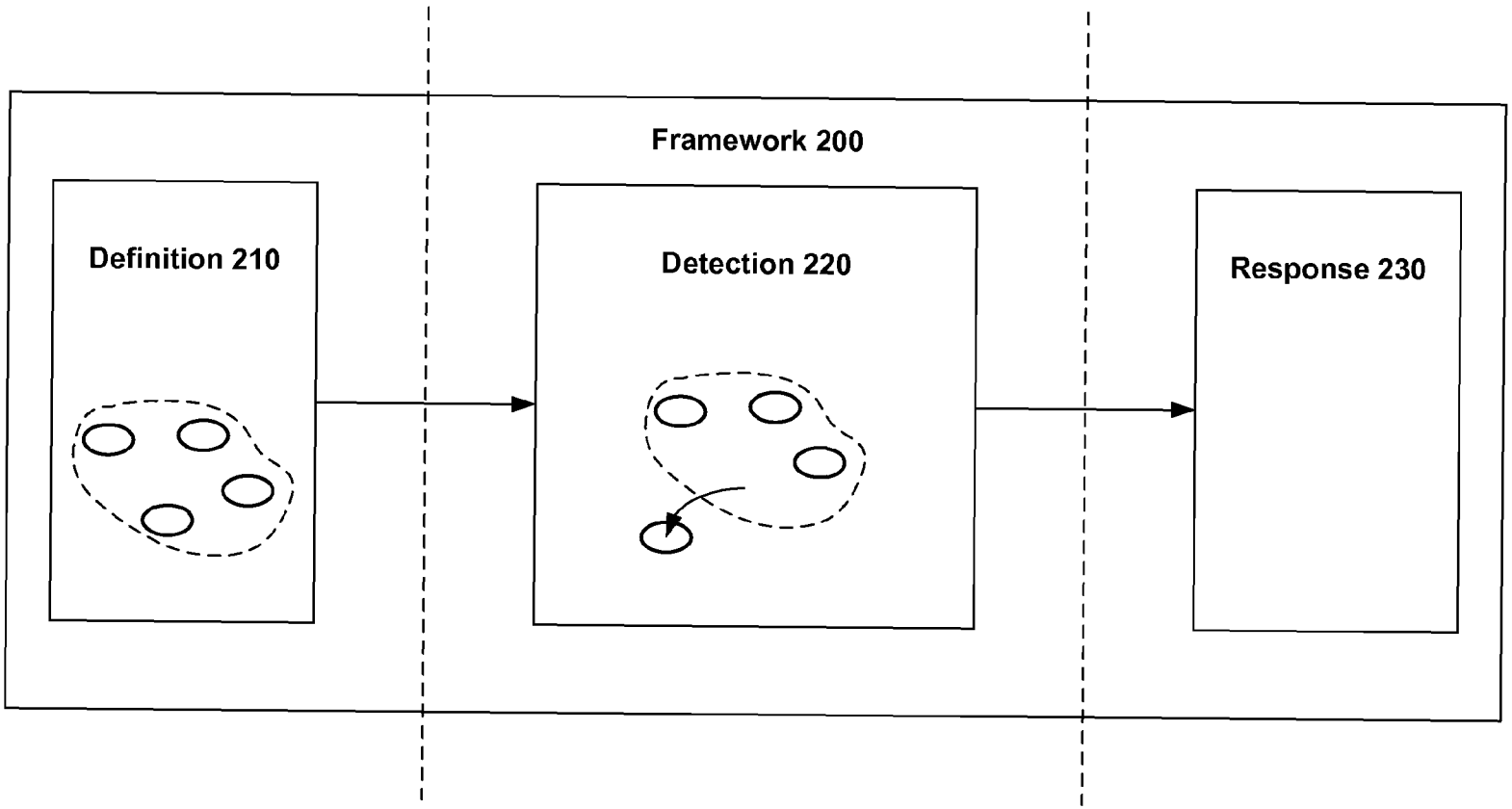
FIG. 2 illustrates an exemplary framework for defining a set of objects, detecting disassociation of object(s) and responding in accordance with the invention.

FIG. 2 illustrates a block diagram of the general framework 200 for detecting disassociation of an object from a group of objects in accordance with the invention. There are three main processes: definition 210, detection 220 and response 230. With definition 210, a person defines a set of related objects and any other structured information about the set of related objects. Once a set of related objects is defined, detection 220 operates to detect if any one or more of the objects disassociates from the set of objects, generating one or more signals. In turn, response 230 operates to respond to the one or more signals to respond to the disassociation event(s), e.g., to notify the user in some fashion, to alert appropriate third parties, to stop another process (like an assembly line), to store the information, to transmit the information to a network, etc.

Figure 3:
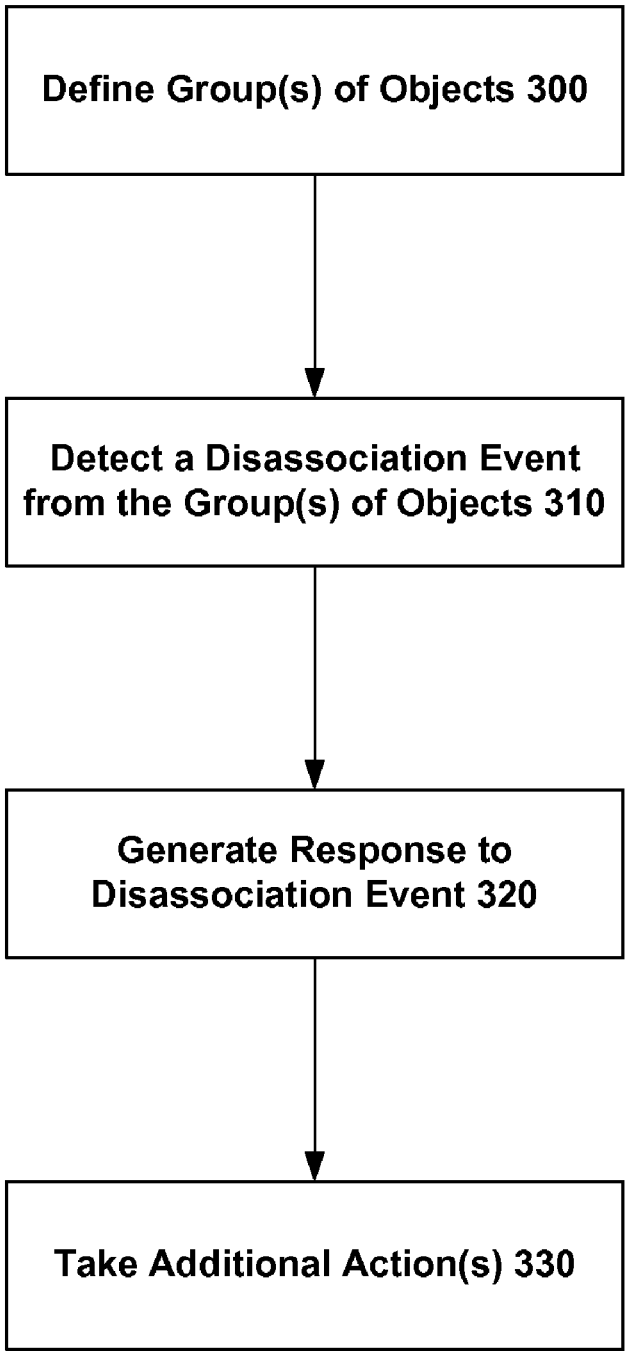
FIG. 3 is an exemplary, non-limiting flow diagram illustrating exemplary aspects of defining a set of objects, detecting disassociation of object(s) and responding in accordance with the invention.

By defining what group of objects are related and how, by defining what constitutes disassociation, and by defining what action(s) should be taken as a response, the general framework of the invention can be applied to practically limitless applications and scenarios, some of which are discussed below. A general flow diagram representing various non-limiting embodiments of the invention is illustrated in FIG. 3. As shown in FIG. 3, a user defines group(s) of objects at 300. Then, at 310, the framework operates to detect disassociation event(s) from the group(s) of objects. Next, at 320, response(s) may be generated or action(s) can be taken to address the detected disassociation event(s). Lastly, additional external action(s) can optionally be taken at 330. For an example of this last step, the response at 320 might be transmitting disassociation event signals to a network service, and external action at 330 could be the network service further processing and/or storing the disassociation event signals, or otherwise taking action on behalf of the group of objects defined at 300.

Definition of Set(s) of Object(s)

As mentioned, a first process in accordance with the framework of the invention includes defining a set of related objects. In this regard, FIGS. 4 through 8 are block diagrams representing various non-limiting ways to define a set of objects in accordance with the invention. In a first example, the invention may be applied to any group of objects, such as a cell phone 400*a*, wallet 400*b*, keys 400*c* and MP3 player 400*d* of FIG. 4, to create a set of equally related objects 410. By "equally related," it is simply meant that the objects are the same for purposes of detecting disassociation in that if any one of the objects is lost from set 410, the framework of the invention will detect such loss, and respond appropriately.

Figure 4:
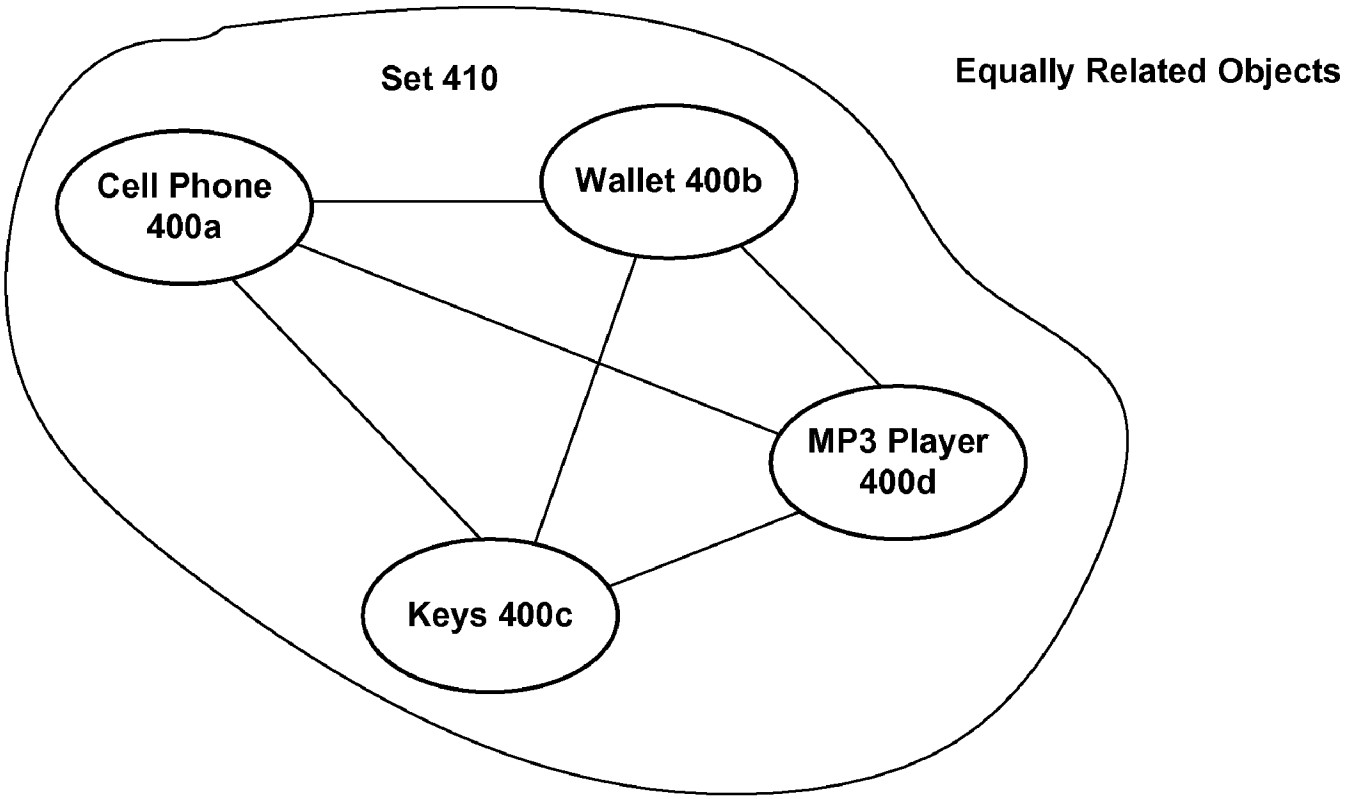
FIG. 4 is a diagram illustrating an exemplary set of equally related objects that can be defined in various non-limiting embodiments of the invention.
Figure 5A:
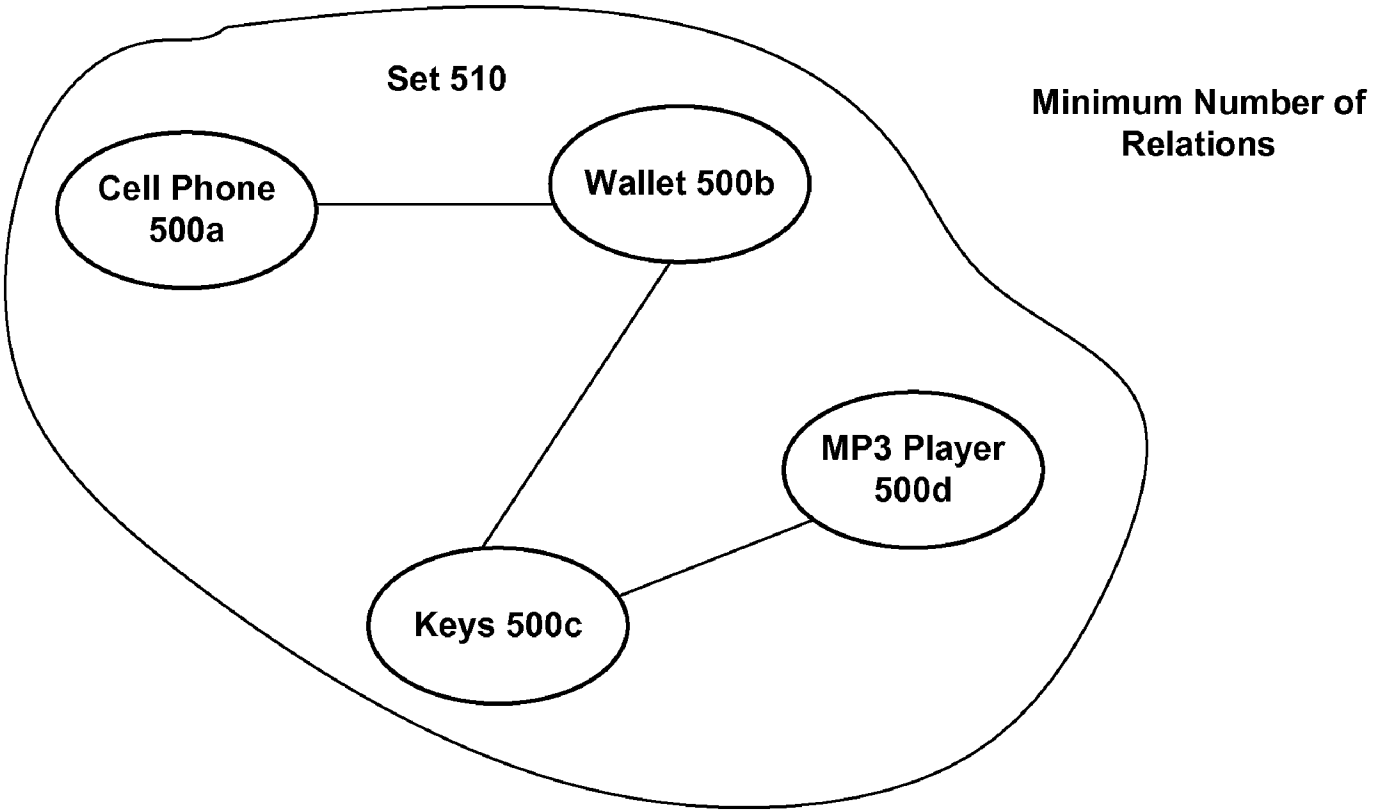
FIGS. 5A and 5B are diagrams illustrating an exemplary set of minimally related objects that can be defined in various non-limiting embodiments of the invention.

As shown in FIG. 4, each of the objects is equally related within the set 410, and each of the objects is shown with a link or relation to each of the other objects in the set. FIG. 5A shows another non-limiting embodiment where each of the objects is equally related as with FIG. 4 in that loss of any of the objects is of equal importance to detect, but FIG. 5A shows that each object need not be generically linked to every other object in the set. For instance, in order to group the objects in a set 510*a*, the minimum number of links for the 4 (or N) objects 500*a*, 500*b*, 500*c* and 500*d* is 3 (or N−1) links.

Figure 5B:
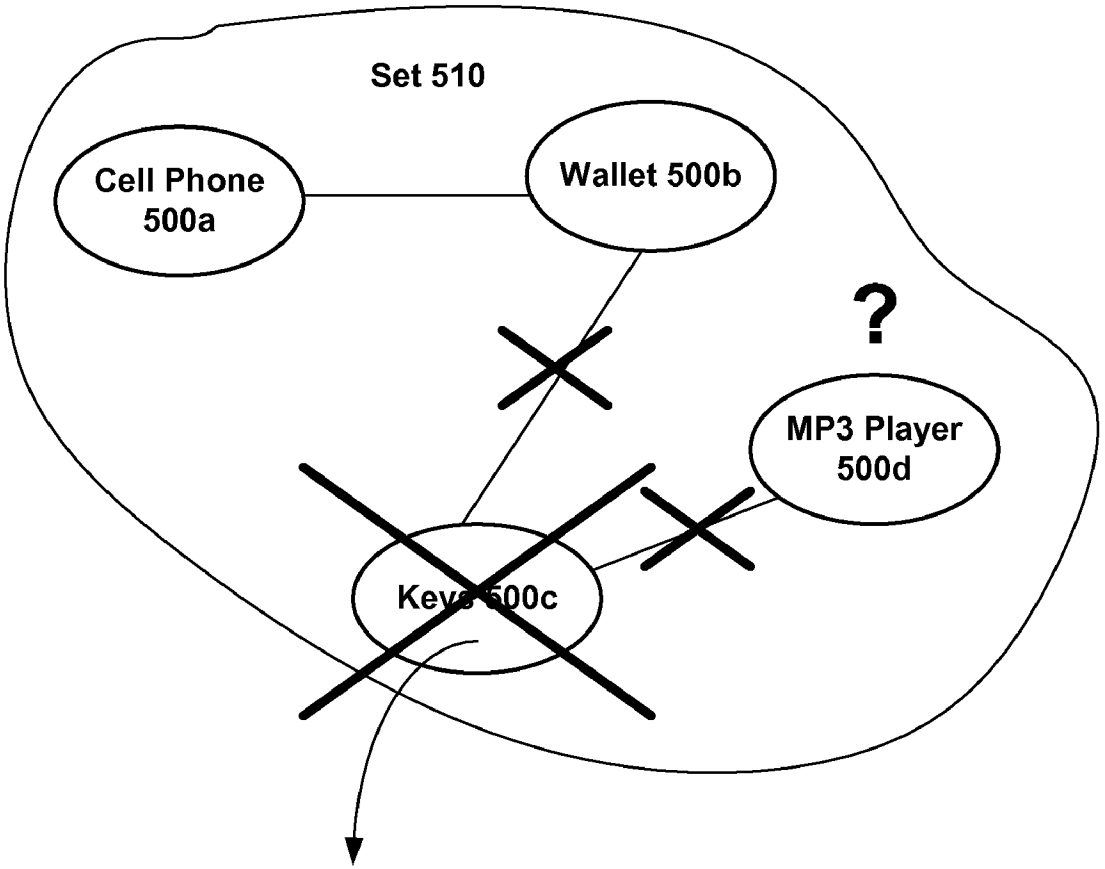

In such a case, as shown in FIG. 5B, the framework of the invention will still operate to detect if any of the objects, such as keys 500*c*, are lost from the set. However, at that point, the status of MP3 player 500*d* will also be unknown, since MP3 player 500*d* was only linked to the other objects of set 510 via keys 500*c*. Thus, depending on the application, it may be helpful to have one or more redundant links in order to continue to operate with cell phone 500*a*, wallet 500*b* and MP3 player 500*d* as the set after loss of keys 500*c*.

Figure 6:
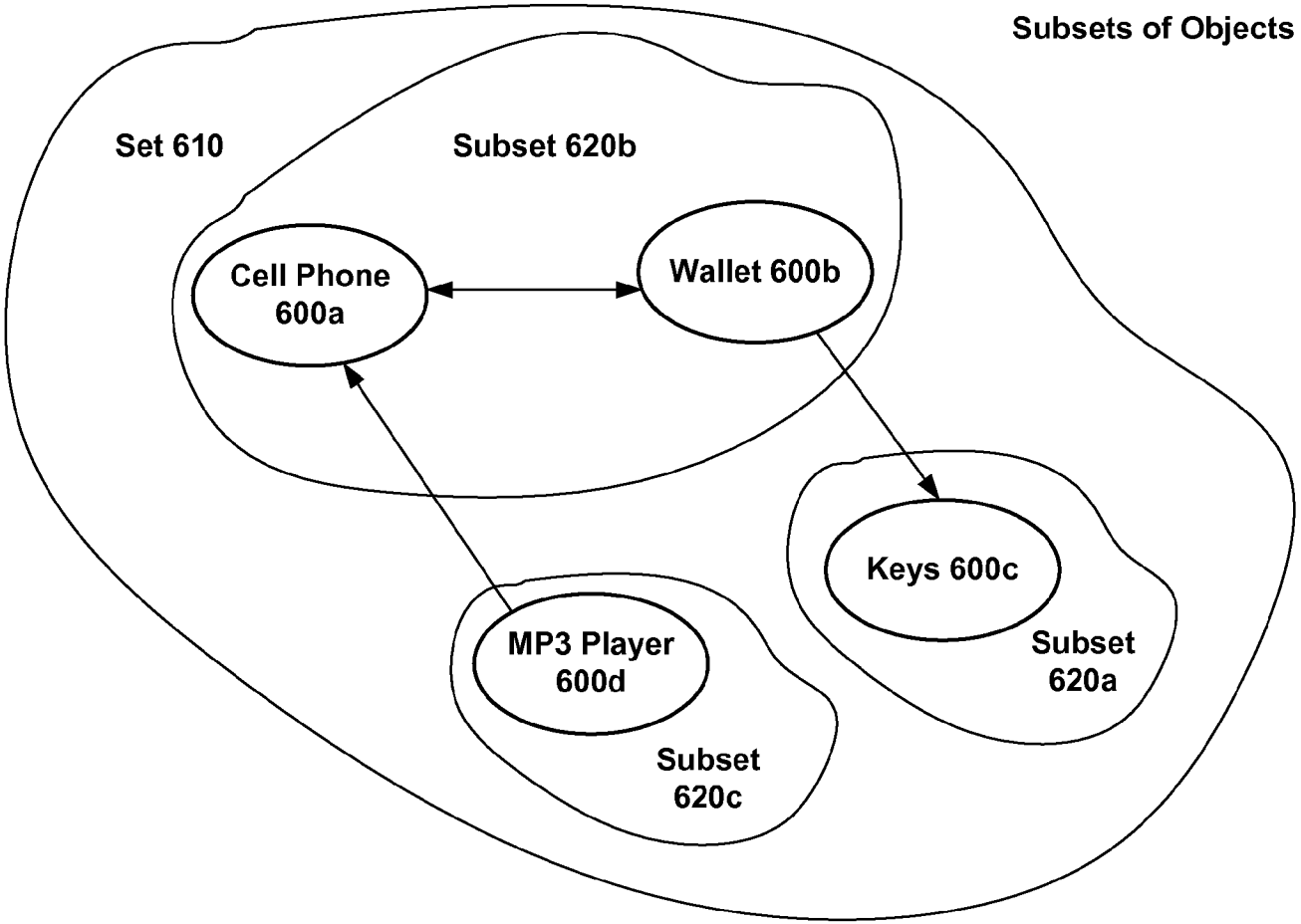
FIG. 6 is a diagram illustrating an exemplary set of objects including subsets of objects that can be defined in various non-limiting embodiments of the invention.

FIG. 6 is a block diagram illustrating an exemplary non-limiting embodiment of the invention wherein objects can be grouped according to subsets, so that not only is it detected in accordance with the invention whether any object, such as any of objects 600*a*, 600*b*, 600*c* and 600*d*, have disassociated from set 610, but it is also detected whether the disassociated object belongs to subset 620*a*, 620*b* or 620*c*. While not shown as such, subsets 620*a*, 620*b* and 620*c* can overlap with multiple subsets including the same object of set 610. Subsets of subsets may also be defined, where desirable.

Figure 7:
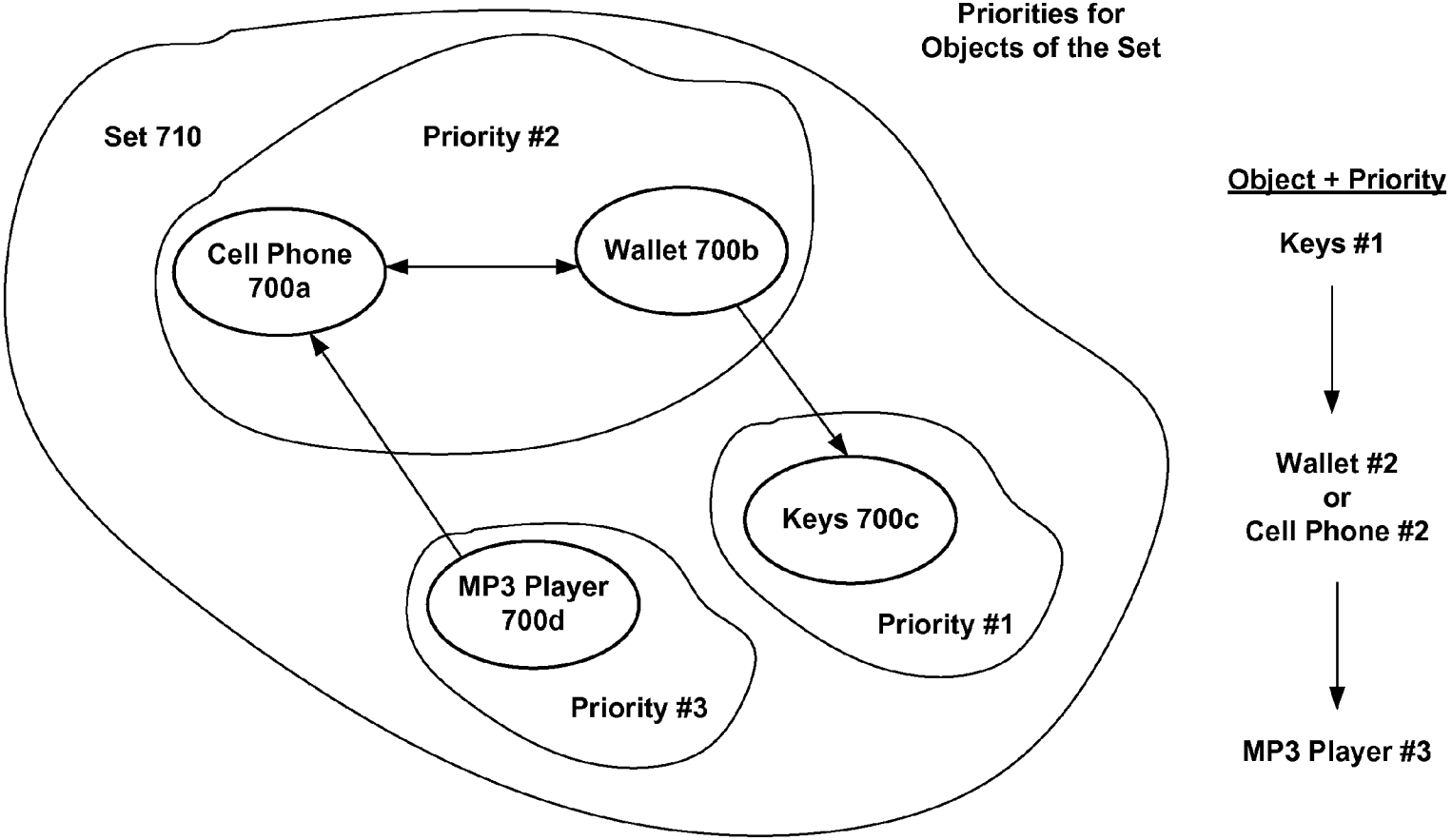
FIG. 7 is a diagram illustrating an exemplary set of objects including prioritization of objects that can be defined in various non-limiting embodiments of the invention.

FIG. 7 is a block diagram illustrating an exemplary non-limiting embodiment of the invention wherein objects 700*a*, 700*b*, 700*c* and 700*d* can be prioritized within the set of objects 710. In this way, more important items can be given more weight when it comes to disassociation. For the example shown in FIG. 7, a person might prioritize their keys 700*c* first because without keys 700*c*, the person might not be able to get back inside wherever the disassociation occurred. Next, the person might prioritize wallet 700*b* and cell phone 700*a* equally as the next most important items, since neither is easily replaceable. Finally, the person might give MP3 player 700*d* the lowest priority because it is the most easily replaced, so that not only is it detected in accordance with the invention whether any object, such as any of objects 600*a*, 600*b*, 600*c* and 600*d*, have disassociated from set 610, but it is also detected whether the disassociated object belongs to subset 620*a*, 620*b* or 620*c*.

Another simple example of a group of money would be to prioritize the loss of stacks of $100 bills over rolls of pennies worth $0.50 each. In such a case, the person would not wish to lose either, but losing the former is a much bigger concern, so extra action could take place in the former case (e.g., immediate law enforcement deployment).

Figure 8:
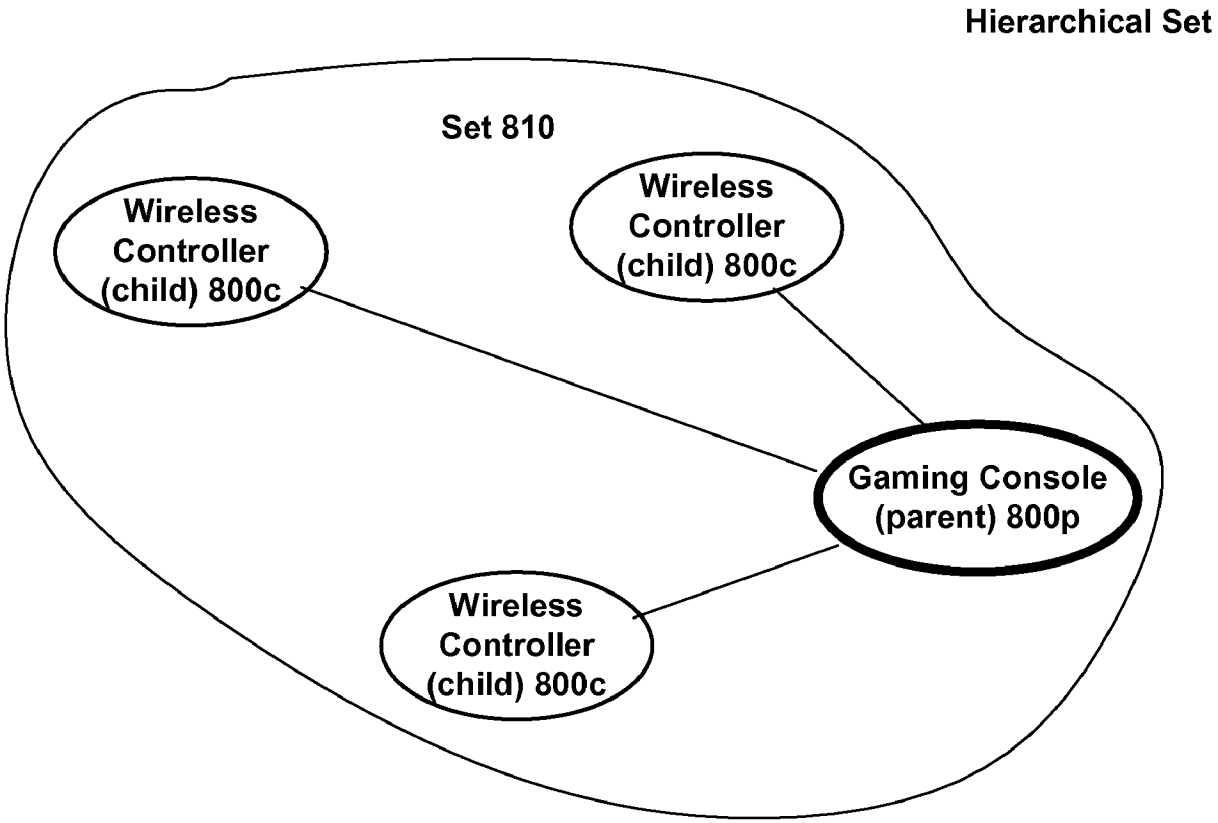
FIG. 8 is a diagram illustrating an exemplary set of objects including hierarchical organization for the objects of the set that can be defined in various non-limiting embodiments of the invention.

As shown in FIG. 8, another exemplary non-limiting definition for a set of objects 810 is shown. In this embodiment, hierarchical set 810 includes a designation of one or more parent nodes 800*p* and one or children nodes 800*c*. In addition to defining which objects are in a set 810, a person may thus also designate a hierarchy to the objects in the set where it may make sense from an application standpoint. For a simple example, it may be desirable to implement a gaming console, such as Xbox, as a parent node 800*p*, and then to ensure that no wireless controllers stray too far from the gaming console to which they apply, the invention can implement the wireless controllers as children nodes 800*c*. In this sense, it may be uninteresting whether the wireless controllers 800*c* separate from one another, but still important to detect whether any of the wireless controllers 800*p* strays too far the console 800*p* itself. In such a case, a hierarchy is defined for the objects of set 810. Sub-hierarchies can also be defined, such that some objects may behave as a child 800*c* for purposes of a particular parent object 800*p* (as shown), but in turn may also behave as a parent object 800*p* for some other set child objects (not shown).

Figure 9:
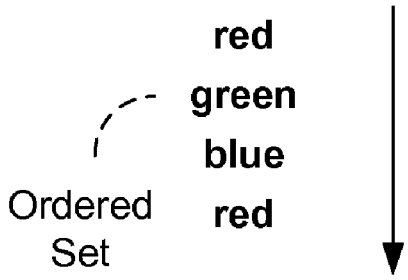
FIGS. 9 and 10 illustrate that objects of a set may be defined to be ordered or unordered, respectively, in accordance with the invention.
Figure 10:
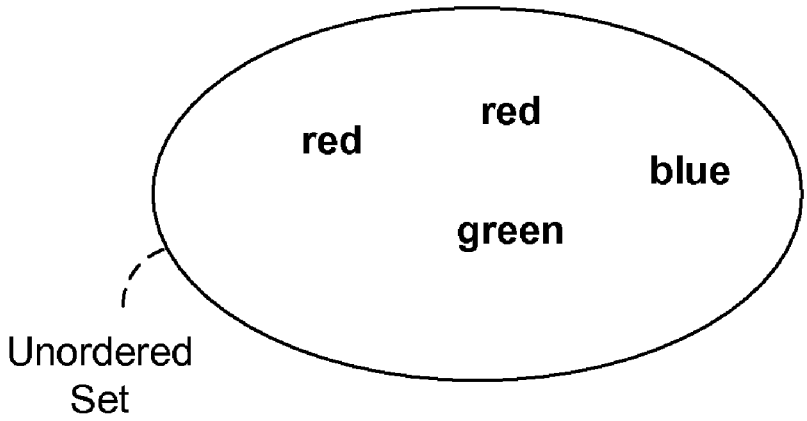

As illustrated by the diagrams of FIGS. 9 and 10, conceptually speaking, hierarchical information can further be broken down into ordered or unordered hierarchical categories, and the invention supports the definition of either, given a relevant application. FIG. 9 conceptually shows an ordered pattern, also known as a list pattern, which requires the sequence of red, then green, then blue, then red again. If any item of the items are out of order, even if present, then the item would be considered disassociated from such a set. A simple example of an ordered hierarchy might be a device that requires batteries to operate, but not the other way around. In such a case, if the device is lost, all items of the set are lost and so it may only be interesting to monitor for disassociation of the batteries from the device, and not the other way around.

FIG. 10 shows an unordered hierarchy, which is also known as a set pattern. The set pattern of FIG. 10 shows the same elements as the list pattern of FIG. 9, but this time, without any order. The set pattern of FIG. 10 thus represents a set of two reds, one green, and one blue in any order whatsoever. It is the occurrence of the elements in the set that is taken into account when detecting disassociation in accordance with the invention, i.e., whether the elements appear in both trees, not in what order the elements appear.

A simple example of unordered hierarchical information might be a set defined as including one A, two Bs and seven Cs (e.g., needed for a recipe). With an unordered set defined as such, three As, two Bs and nine Cs may actually be grouped together, e.g., on a truck, but if one or two As or one or two Cs fall off the truck, then no disassociation event will be recorded because at least one A, two Bs and seven Cs will still be present in the truck, enough to satisfy the unordered set. If, however, three As, any B falls off the truck, or three or more Cs fall off the truck, then the conditions of the unordered set are no longer met, and a disassociation event has occurred.

Figure 11:
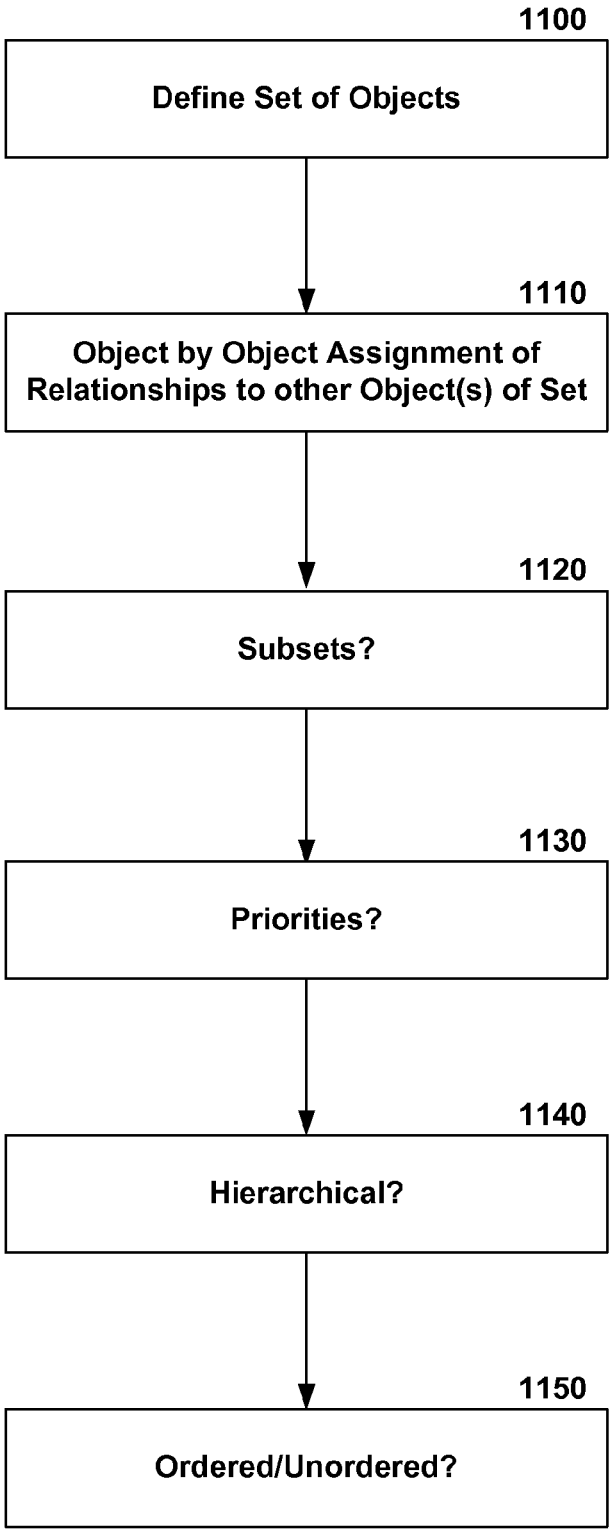
FIG. 11 is an exemplary, non-limiting flow diagram illustrating exemplary options for defining structural information for a set of objects in accordance with the invention.

Thus, as described according to the various embodiments herein, definition of a set of objects in accordance with invention may include a variety of additional structured information that refines the relationships of the objects of the set. Some of the various kinds of additional structured information that can be defined for a set is illustrated in the exemplary non-limiting flow diagram of FIG. 11. In the diagram, at 1100, with a basic definition, a group of objects are specified. At 1110, a user can optionally specify object-to-object relationships within the set. This might include defining subsets at 1120, or priorities at 1130, or hierarchical information 1140, and further specifying whether any order applies to any hierarchical relationships at 1150.

Disassociation of Object(s) and Generation of Signal(s)

Figure 12:
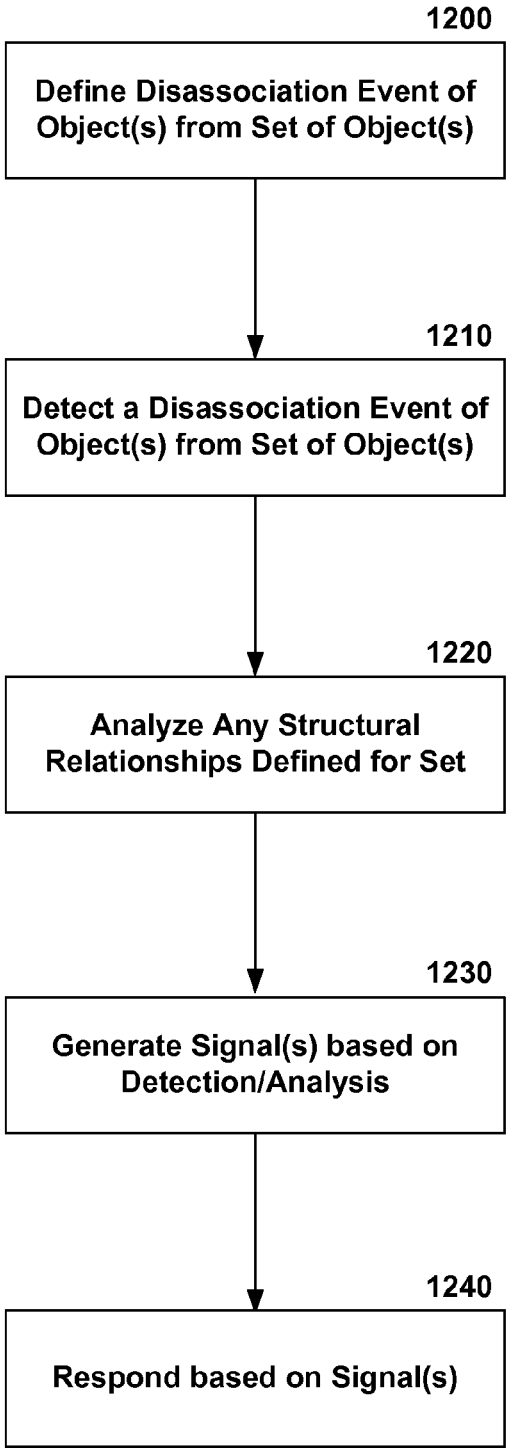
FIG. 12 is an exemplary flow diagram illustrating non-limiting aspects of detecting a disassociation event for a set of related objects and responding to the disassociation event in accordance with the invention.

Having defined a set of object(s) per any one or more of the above-described object relationships, the flow diagram of FIG. 12 illustrates exemplary non-limiting processes for practicing the invention. At 1200, disassociation events are defined relative to a set of objects and its relationships. For instance, in a simple case, disassociation might be defined as any object moving too far away from one or more of the other object(s) of the set. At 1210, once in operation, any disassociation events as defined are detected, which means that one or more objects of a set of object(s) has disassociated from the set. At 1220, any structural relationships beyond mere association are analyzed to determine whether the disassociation event affects the set in a manner that is significant to the application. If so, then at 1230, one or more signals may be generated by one or more object(s) of the set to represent the occurrence of the disassociation event(s). Then, at 1240, one or more responses can be taken based on the signal(s).

Response to Signal(s) Generated Due to Disassociation

Figure 13:
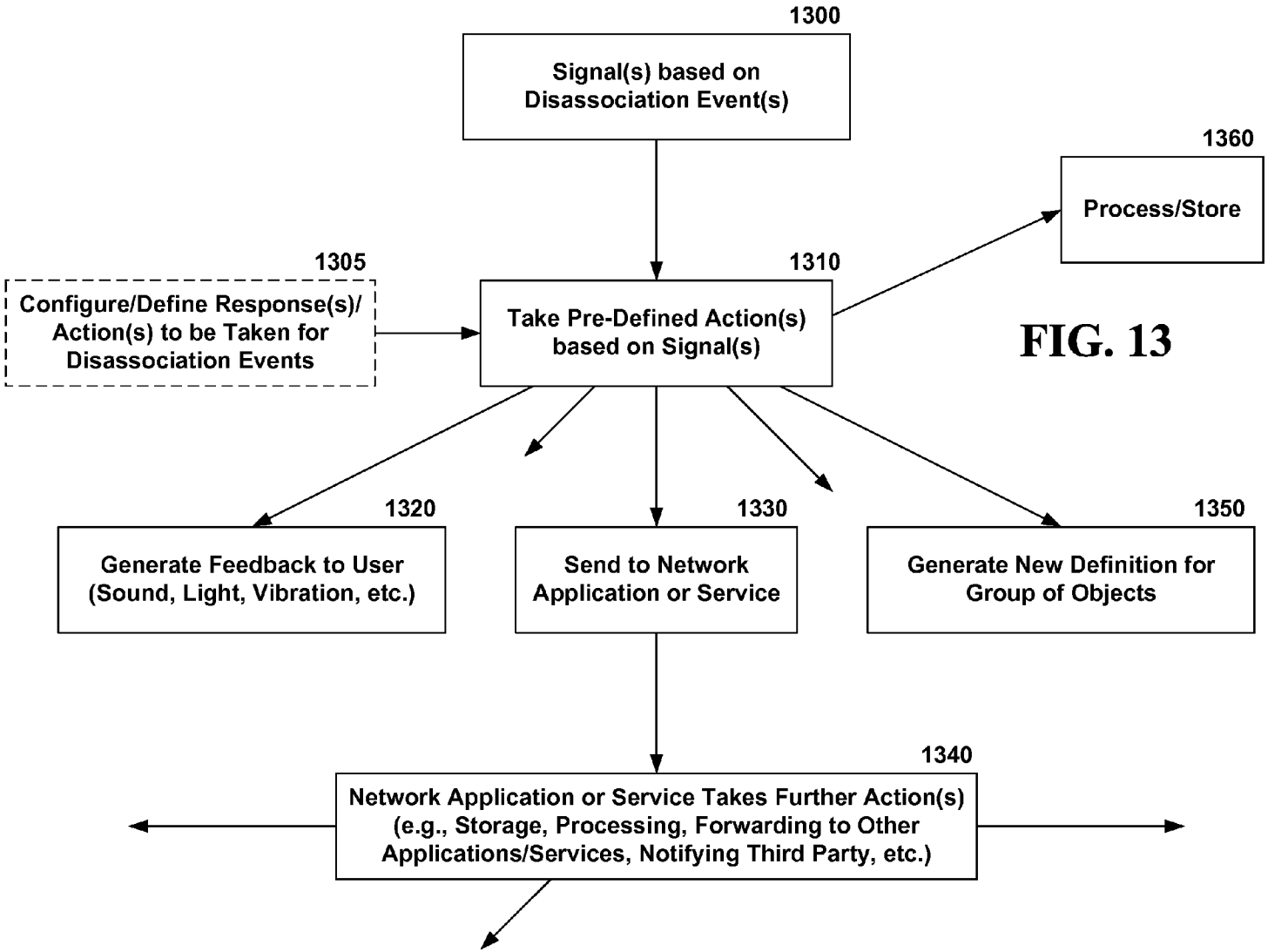
FIG. 13 is an exemplary block diagram illustrating non-limiting aspects of responding to a disassociation event in accordance with the invention.

FIG. 13 illustrates an exemplary flow diagram illustrating exemplary response to disassociation signal(s) generated due to disassociation of one or more objects from a set of objects in accordance with the invention. At 1300, any signal(s) representing disassociation event(s) are received by one or more of the object(s) responsible for responding, or if the signal(s) are local to one of the object(s) responsible for responding, the signal(s) are locally routed to one or more components, such as alarms, lights, motors, odor-release agents, etc., that respond to the signal(s). At 1310, pre-defined action(s) are taken based on the signal(s). In this regard, at 1305, the response(s)/action(s) to be taken based on the signal(s) may be defined, customized, or otherwise configured in advance according to parameters to take action(s) appropriate to the disassociation event(s) represented by the signal(s).

While the action(s) that can be taken at 1310 are virtually limitless, some common actions might be to generate feedback to a nearby person at 1320, e.g., aural feedback, such as an alarm, visual feedback, such as flashing lights, and/or mechanical feedback, such as vibration, aromatic feedback, such as release of a pungent gas, liquid, etc., i.e., any known way to alert a person to the disassociation event.

Another common response might be to transmit information about the disassociation event at 1330 to another application or service via a network. Once received by the application or service, at 1340, the application or service may take supplemental action disconnected from the set of objects itself. For instance, the application may save the disassociation event information in a data store, further process the disassociation event information, forward the disassociation event information to other applications/services, notify a third party, such as an emergency professional, of the disassociation, automatically contact the owner of the object(s) via telephone, email, etc. Again, the number of actions that can be further taken by an application or service receiving the disassociation event information is virtually limitless, and only a few such responses are listed here.

Other common actions might be to automatically redefine the set of objects to account for the disassociated object. For instance, after a set of 4 objects loses an object, it may be desirable to continue to carry out the invention for the set of 3 objects that remain, and so re-defining the set may be automatically performed at 1350. Another example of a response that can be taken based on the signal(s) is to locally process and/or store the disassociation event information at one of the object(s), at 1360, e.g., by any object having a computer processor and storage. Any combination or permutation of the foregoing may also be carried out at 1310 as well.

Thus far has been described a general framework for defining various kinds of sets of objects, detecting disassociation events for a set of objects and responding based on the disassociation events. Below described are various non-limiting implementations that achieve one or more aspects of the above-described embodiments of the invention.

Non-Limiting Implementation of Detection Framework

In various non-limiting implementations, to define a set of objects or items, each item of a set of items is marked or integrated with some element, e.g., with electronic or biological means, such that it can be sensed whether an item disassociates from the set, e.g., if the item is brought to a state where the item is regarded as too far from one or more other objects of the set.

Figure 14A:
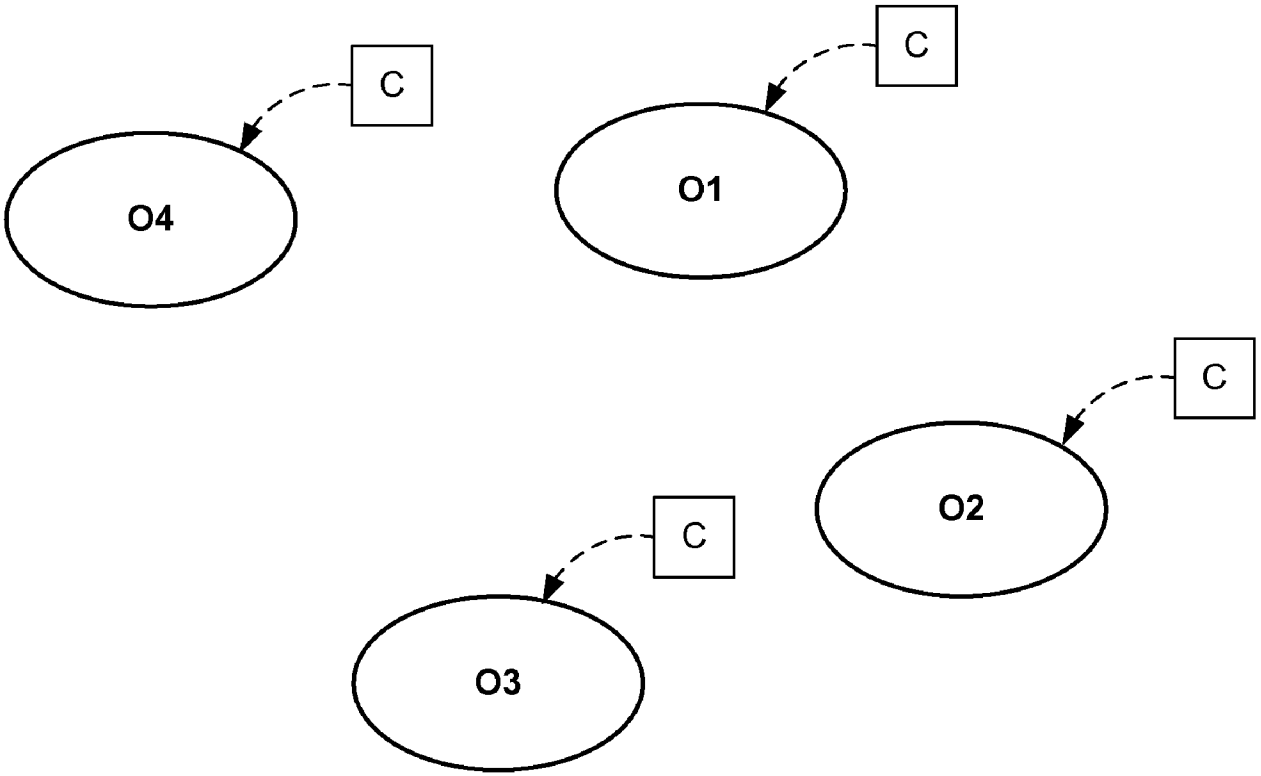
FIGS. 14A, 14B and 14C illustrate various electronic ways to implement the framework for detecting disassociation of an object from a set of related objects in accordance with the invention.
Figure 14B:
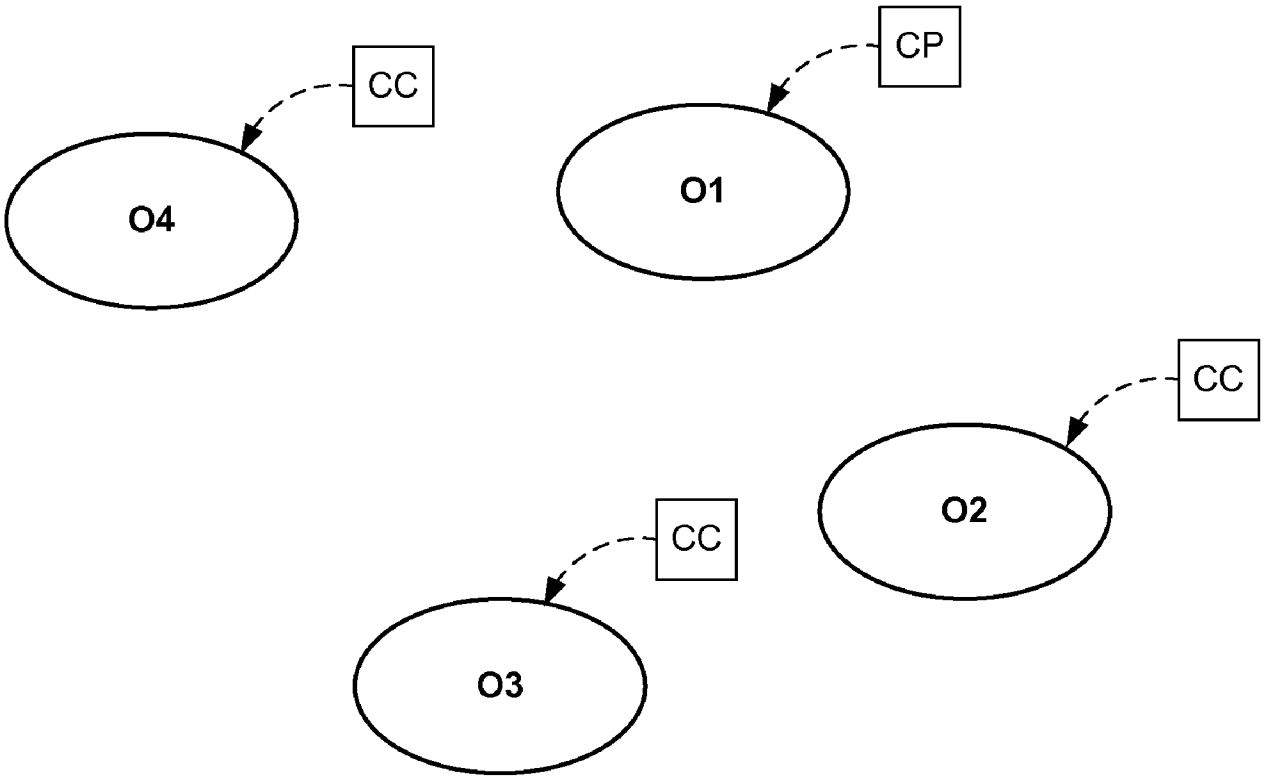
Figure 14C:
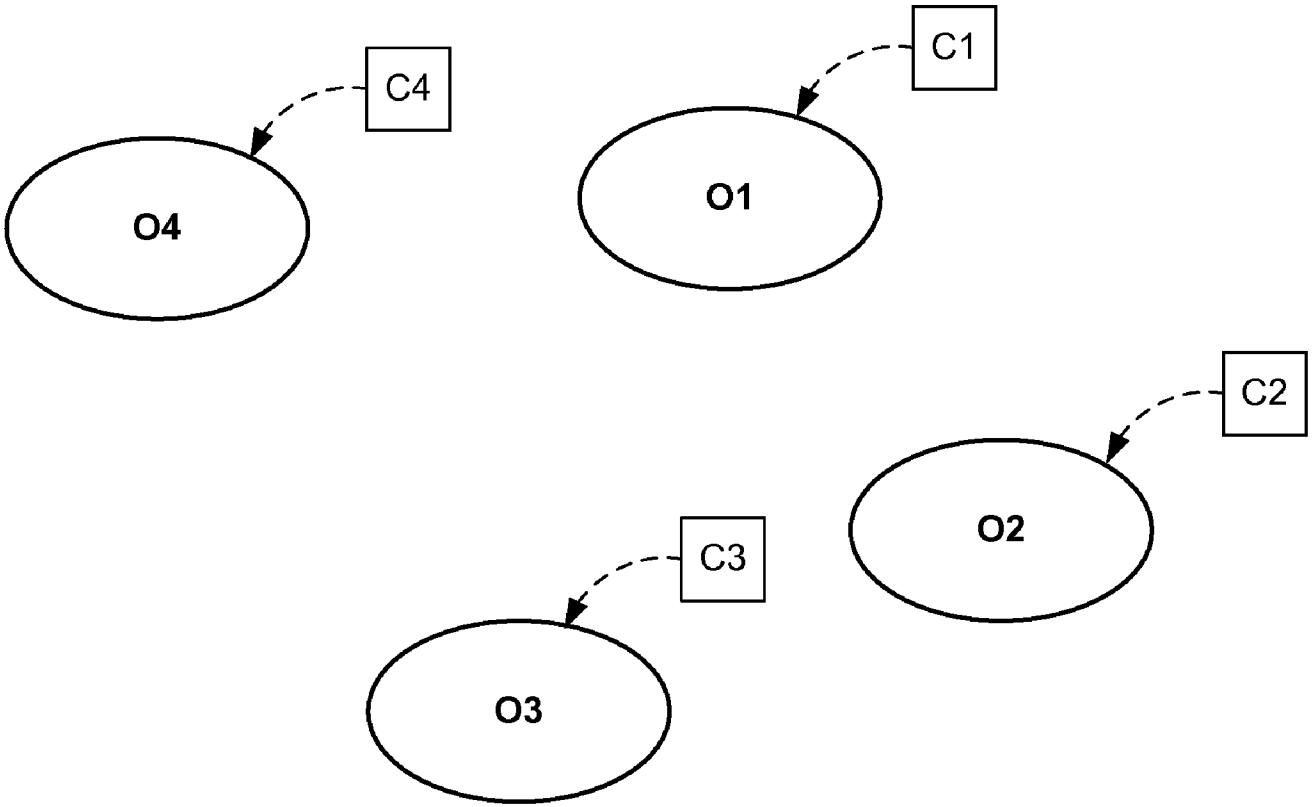

FIGS. 14A to 14C illustrate exemplary implementations of the invention wherein one or more electronic components are provisioned to provide the detection capabilities of the invention. As shown in FIG. 14A, as a first exemplary non-limiting implementation of the invention, an integrated circuit, e.g., chip C, provides any of the above-described functionality. For a simple example, a chip C of a set of chips (e.g., pre-associated at the factory) is attached to or integrated with each object O1, O2, O3, O4. Each object to which an activated chip C is attached then becomes part of the set of related objects defined in accordance with the invention. Each chip C is also provisioned with the ability to detect any other activated chips C within a pre-defined range. If any one object exceeds the pre-defined range from another object in the set, a disassociation event has occurred, and a signal is generated by chip C of the set of objects that detects the disassociation event.

As described above, any object that detects the disassociation event can generate one or more responses. For instance, if object O3 moves to the right, object O3 will still be proximate to objects O1 and O2, but might move out of range of object O4, in which case object O4 (and possibly object O3 too) will generate a response, such as an alarm.

In another non-limiting implementation, a disassociation event does not occur unless the disassociating object disassociates from all of the objects of the set according to pre-set criteria. For instance, in the case of proximity detection, and again considering the movement of object O3, a disassociation event will not be generated in this non-limiting implementation unless the object O3 moves to a position that is beyond the detection of all of the other objects of the set. In this case, that would translate to object O3 exceeding a pre-defined distance from each of objects O1, O2 and O4, in which case one or more of the objects may respond, e.g., notify the user via an alert. In one non-limiting implementation, it is the chip C of the disassociating object that makes the sound. In an alternate implementation, where objects O1, O2 and O4 can share information via chips C, any one or more of objects O1, O2 and O4 may respond.

In accordance with the presently described embodiment, chip C need not provide all of the by itself, but rather chip C can be multiple chips or components that are communicatively coupled. For instance, a first component might operate to emit proximity information from the object with which it is integrated, another component might operate to continuously detect proximity information from other objects, and another component may operate to process and respond to the detection information.

As illustrated in FIG. 14B, each electronic component attached to each object need not be the same. For instance, where a parent/child node relationship is desired as a definition of a set of objects, a set of different electronic components can be provided. Where the electronic components are implemented as chip, for instance, child chips CC or parent chips CP can be separately attached to or integrated with objects O1, O2, O3 and O4. In the example shown, each of objects O2, O3 and O4 are provisioned with a child chip CC and object O1 is provisioned with a parent chip CP. As a result, objects O1, O2, O3 and O4 define the set of objects once the chips are activated (e.g., powered). In such a case, full functionality is not required of each chip. For instance, parent chip CP may be the only chip capable of detecting proximity information, and further acting on the proximity information, whereas child chips CC might merely operate to emit proximity information to detector of parent chip CP.

A non-limiting implementation of the parent/child relationship includes designating a "primary item" for the group, such as a mobile device. This device would then be the "parent node" that would ensure to give a signal in the event that objects "child nodes" would be separated by too much distance, for example, based on signal strength. Global positioning satellite (GPS) technology could also be integrated with one or more of the objects of the set of objects to make absolute measurements of locations, from which proximity of an object to another object of a set of objects can be inferred, and the exact position of the set of objects at disassociation time can be calculated.

FIG. 14C illustrates another non-limiting implementation where objects O1, O2, O3 and O4 are each provided with separate, independently programmable electronic components C1, C2, C3, and C4. In such implementation, a user configures the components C1, C2, C3 and C4 according any of the above-described definitions for relationships for a set of objects, further defines what constitutes disassociation events for the set of objects, and also defines what action(s) to take from a group of possible actions. A user can either configure the electronic components directly during an activation process, or the chips C1, C2, C3 and C4 can be custom ordered or built, or various pre-configurations can be selected that address common scenarios.

While FIGS. 14A to 14C illustate four components, any number of N objects can be accommodated by providing N components. In this regard, different electronic components can be provisioned for different definitions of groups defined in FIGS. 4-8 to facilitate setting up groups of objects.

Figure 15A:
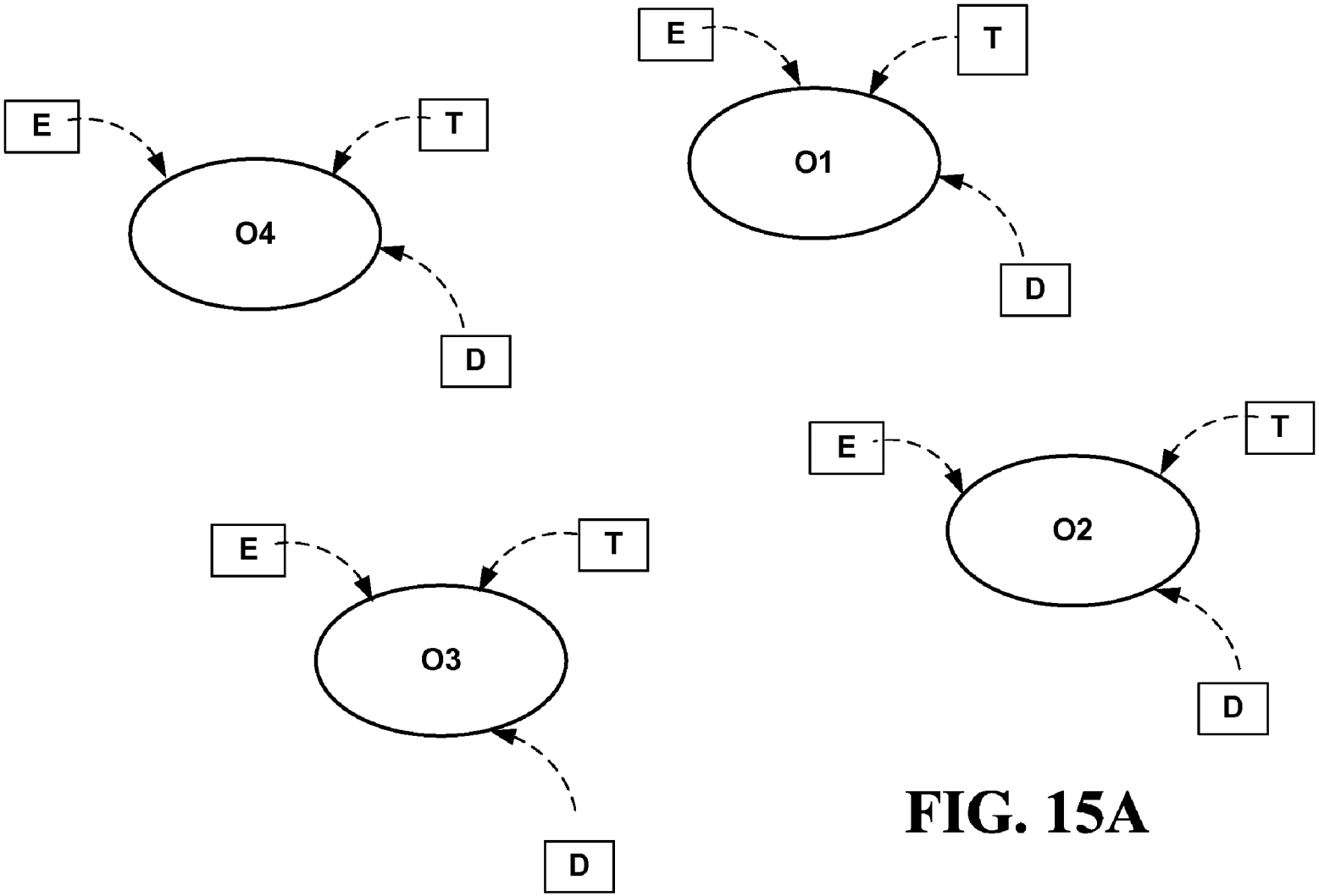
FIGS. 15A and 15B illustrate other ways to implement the framework for detecting disassociation of an object from a set of related objects in accordance with the invention.
Figure 15B:
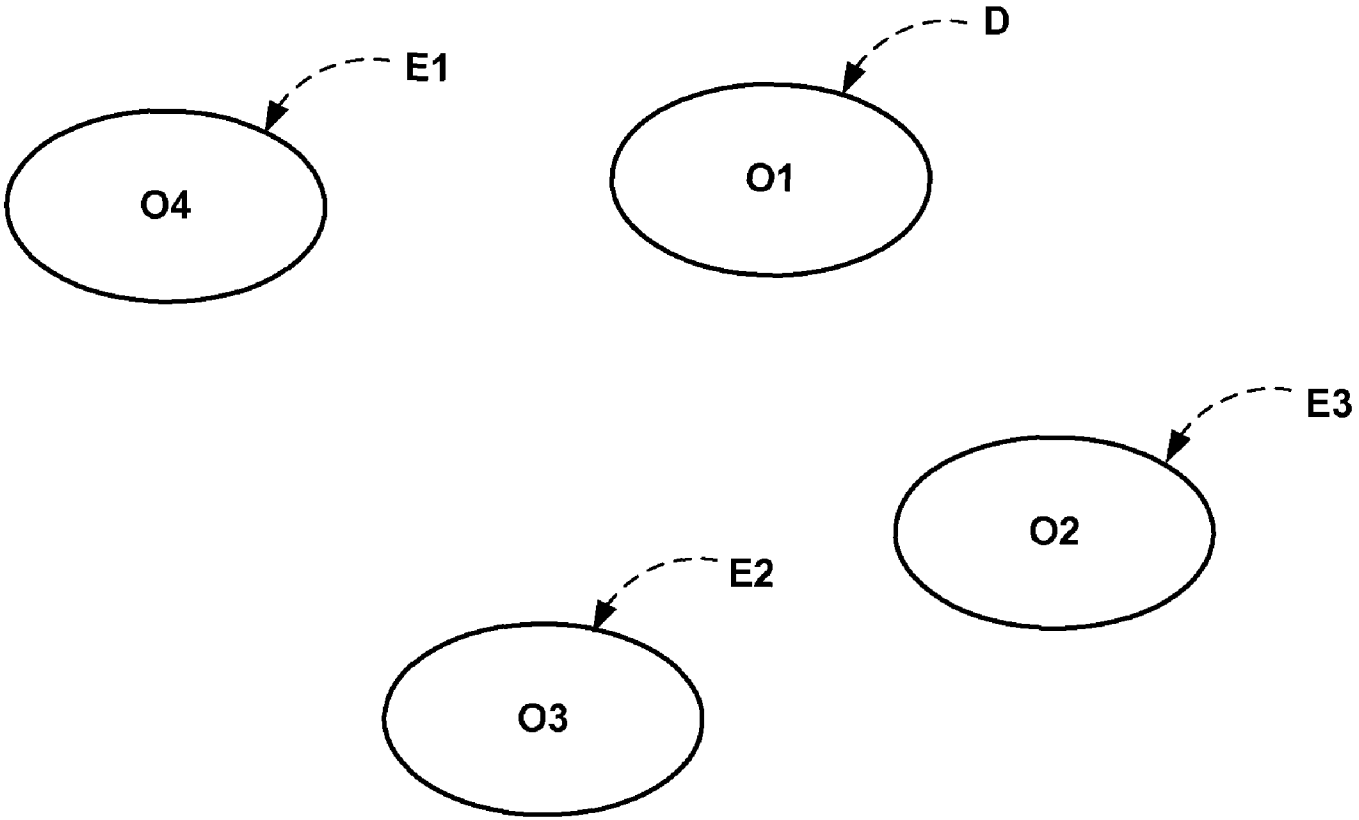

Additionally, as mentioned, any of the components could be multiple components to provide separate functionality for a single object. This is illustrated in FIG. 15A where each object O1, O2, O3 and O4 is optionally provisioned with one or more of (1) an emitter E to emit detection information, (2) a detector D to detect detection information emitted from emitters E of other objects and (3) a transmitter T which initiates a response, either by sending a signal locally to generate feedback or by transmitting the signal to a network for further action.

In an exemplary implementation of the parent/children relationship for a set of objects, children O2, O3 and O4 are each provisioned with emitters E3, E2 and E1, respectively, which emit the same or different detection information. The parent object O1 in turn is provided with the detector D which detects the detection information and determines whether a child has disassociated from the set, and if so, takes appropriate action (e.g., sound an alarm). Additionally, difference components can be provisioned with different proximity thresholds, so that if there are 3 objects X, Y and Z, X and Y are regarded to disassociate if they reach distance d1 from one another whereas Z is not regarded to disassociate from either X or Y unless it reaches a distance d2=4*d1 from X or Y.

The electronic components referred to in the above-described non-limiting implementations may be any electronic components that operate to send detection information through the air. In this regard, any wireless means of communicating can be used among components, which can be implemented as an integrated circuit. For instance, any wireless protocol, such as Bluetooth, 802.11x, etc., can be used to exchange information among components. In one non-limiting embodiment, when the signal from an object is no longer received by another object in the set (or all other objects), the object is disassociated from the set. In an alternate embodiment, where the signal strength from one object to another object is measurable, distance can be set as a function of pre-defined signal strength.

Other implementations for marking objects includes using known Radio Frequency Identification (RFID) technology, wherein each object is provisioned with an RFID tag, to be interrogated by a transponder (i.e., the detector). When an RFID tag is no longer detected by the transponder of the interrogating object, the object associated with the "lost" RFID tag is regarded as disassociated from the set. When it comes back within range of the transponder, it re-associates. Such an embodiment may be suitable, for instance, to associate keys with a wallet. For instance, an RFID tag can be placed on the keychain, and an RFID transponder can be integrated into the fabric of a wallet, or provided as a separate object somewhere inside the wallet. When the keys go out of range, the wallet will generate a signal from which appropriate action can be taken. In this regard, any frequency that can be emitted through air, e.g., radio waves, microwaves, etc., can be used to attempt to communicate among a set of related objects in accordance with the invention.

Another way to implement any one or more of the non-limiting embodiments of the invention includes light-based implementations. Light-based implementations of the invention can include camera based, image processing techniques. Any image based algorithms can be used to detect one or more objects defined as part of the group. For instance, bar code scanning technology can operate to determine if all objects of a group of objects are present. In such an embodiment, the bar codes of a set of objects to be associated are scanned to define the set. Then, in operation, whenever not all of the bar codes are observable as part of a set, then a disassociation event occurs in accordance with the invention. This might be useful in a shipping center, where multiple items should be shipped together.

Another light-based implementation of the invention includes light emission, either in the visible spectrum or non-visible spectrum, wherein the objects of the group emit the same or different light, and a detector detects the presence or absence of such light from the set to determine whether any objects have disassociated.

Another exemplary non-limiting implementation of the invention includes a set of objects that each have network connectivity, wherein some of the intelligence or processing of detection information is offloaded to an application on the network that communicates and takes action on behalf of the set of objects. A set of cell phones, for instance, can be pre-associated so that it is known whether any of the cell phones (e.g., of teenage children) goes farther than 100 miles from home. It is noted that for real-time detection using such a network interaction, such as high speed pinging over TCP/IP based networks, may require good Quality of Service.

Thus, the invention can optionally be implemented with a variety of electronic means, which can be combined and/or permuted according to the particular scenario where multiple, or overlapping, detection techniques are desirable. The invention, however, is by no means to be considered limited to electronic means. Additionally, the marking of the objects of a set of related objects could also be based on odor detectors or other sensory devices from which proximity information among the objects can be detected.

For instance, in the case an odor, depending on the application, one object can be provided with a pre-defined chemical composition that evaporates in the air. Each object so provided becomes an emitter, as described. Another object could be provided with a sensor for that pre-defined chemical composition. As long as the sensor detects the pre-defined chemical composition in sufficient quantities, then the objects are regarded as associated. When the sensor detects fallen levels of the pre-defined chemical composition, it can be inferred that disassociation has occurred at some point. The chemical composition may optionally be a biological airborne substance, such as a harmless virus. For some applications, e.g., where biological objects are involved, a sensor of genetic information may be utilized to track the set of biological objects, e.g., in a petri dish.

In yet another implementation of the invention, magnetic principles can be used, whereby each object is provided with magnets (which may be of the same strength where the objects of the set are unordered, or of varying strengths to differentiate among objects for structural information). With a magnetism sensor provided with one of the objects to detect the magnetic strength originating from the objects of the set, disassociation from the set of objects can be determined as function of the strength of magnetism originating from the various objects of the set. When magnetic pull from the other objects for an object falls below a certain threshold, the object becomes associated. Similarly to the operation of a magnetic implementation, for objects that are radioactive, radioactivity is also detectable.

Accordingly, there are many ways to provision objects with one or more components that at least one of emit, or detect disassociation event information in accordance with the invention. As mentioned, signal(s) are generated in response to the disassociation event information by the detector of the disassociation event. As described above, any of a variety of responses can be taken in response to such signal(s), and there are several ways such responses can be implemented.

In an exemplary non-limiting embodiment, additional response circuitry is provided with any object having a detector. For instance, in one embodiment, each object with the ability to detect disassociation can be provisioned with an alert, such as a microchip alarm that operates by sound, light, and/or vibration. Advantageously, with the above-described invention, the end user is thus immediately informed when object(s) of a pre-defined group of objects separate. As can be observed from the variety of above-described non-limiting embodiments and implementations, the invention is not limited to any one specific emission or detection technology, but rather should be thought to encompass all known electronic, chemical, biological, or physical means of communicating information from one object to another and/or detecting that information.

Non-Limiting Scenarios for Detection Framework

The general framework for defining a related set of objects, detecting an object disassociating from the set and responding based on object disassociation in accordance with the invention can be applied to practically limitless scenarios, some of which have been described in above discussions and in addition numerous other scenarios are identified in this section.

A clear business scenario that would benefit from the techniques of the invention would be to decrease the error rate in handling goods in Supply Chain Management. For instance, if a customer order consists of: one computer, one printer, one computer-printer cable and two power cords, by associating such items during processing, it would not be possible to ship that order if one item (e.g. a computer-printer cable) was missing. The larger and more complex that orders become, the more need there is for such a solution.

Another example application of the invention might include supervision of kindergarten children, e.g., a real world parent/child relationship. In this regard, one of the chores that adults have when making, e.g., a field trip, is to actually count the number of school children when entering the bus, when leaving the bus and so forth. The invention could be used to immediately determine the absence of a child. In addition, using the context aware proximity alert techniques of the invention would operate anywhere outside the bus as well, e.g., inside the auditorium, or zoo, etc. by adjusting the distance within which all children must be for the context of the field trip.

As mentioned, numerous scenarios and applications for the invention have been identified herein; however, for the avoidance of doubt, the invention should not be considered in any way to be limited to any of these identified scenarios. To the contrary, as described above, the variety of embodiments enabled by the framework for detection of object disassociation in accordance with the invention can be applied to any set of real-world objects. For instance, the invention could be used as between or among (A) Kids and mothers, (B) Keys/bag and mobile phone, (C) Cars and hubcaps, (D) Cables on a bridge, (E) Train carts or (F) any set of objects for which it is desirable that they remain together.

Exemplary Networked and Distributed Environments

Figure 16:
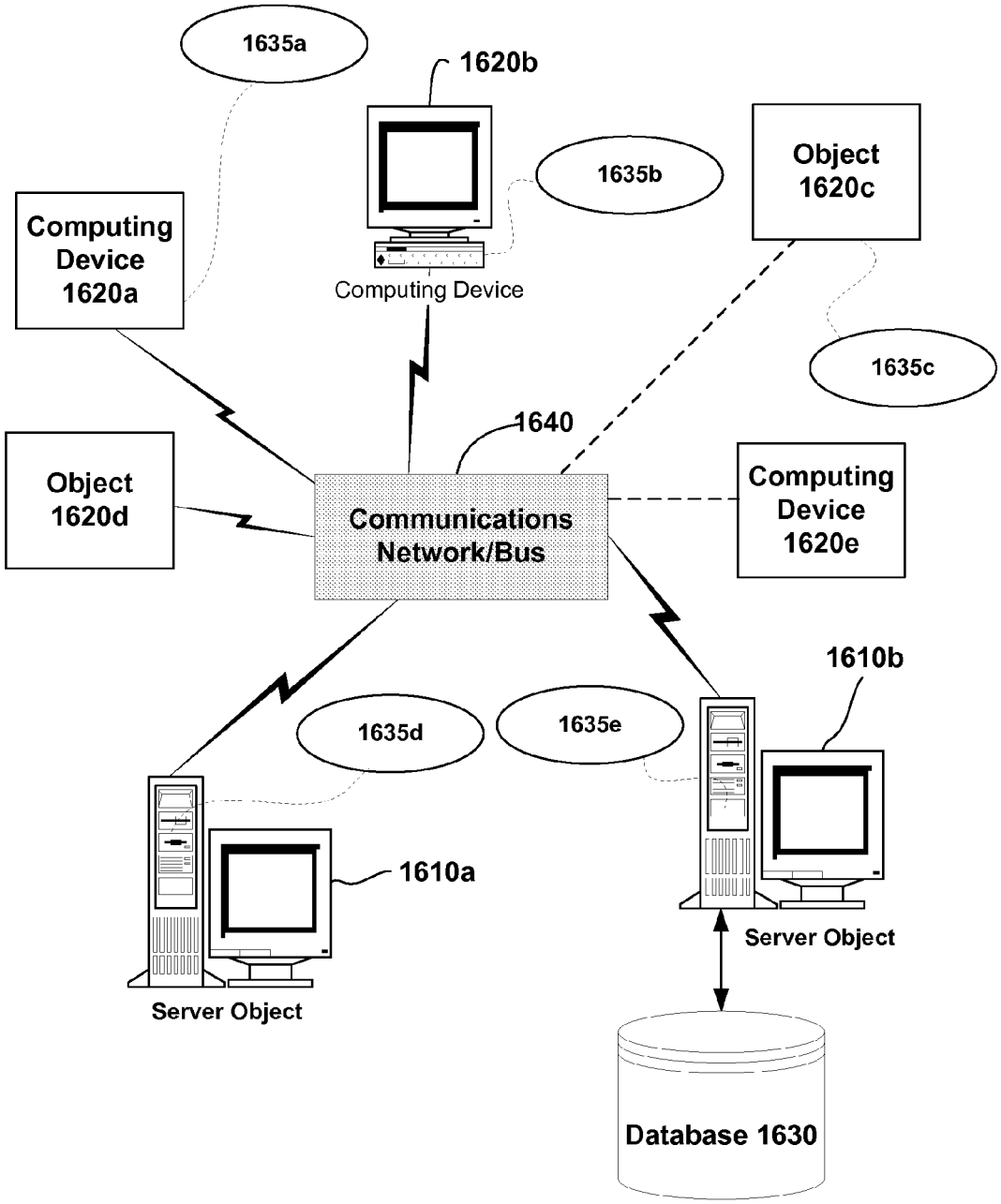
FIG. 16 is a block diagram representing an exemplary non-limiting networked environment in which aspect(s) of some embodiments of the present invention may be implemented.

One of ordinary skill in the art can appreciate that the invention can be implemented in connection with any physical item, which might include a handheld device, computer, other client or server device, printer, phone, etc. which can be deployed as part of a computer network, or in a distributed computing environment, connected to any kind of data store. In this regard, the present invention pertains to any objects of a set of related objects, and any one of the objects may include network communication capability.

Where one or more of the objects of a set of related objects defined in accordance with the invention includes a network capability, the present invention may optionally apply to an environment with server computers and client computers deployed in a network environment or a distributed computing environment, having remote or local storage, as shown in FIG. 16.

Distributed computing provides sharing of computer resources and services by exchange between computing devices and systems. These resources and services include the exchange of information, cache storage and disk storage for objects, such as files. Distributed computing takes advantage of network connectivity, allowing clients to leverage their collective power to benefit the entire enterprise. In this regard, a variety of devices may have applications, objects or resources that may take further action on disassociation event information in accordance with the invention.

FIG. 16 thus provides a schematic diagram of an exemplary non-limiting networked or distributed computing environment. The distributed computing environment comprises computing objects 1610*a*, 1610*b*, etc. and computing objects or devices 1620*a*, 1620*b*, 1620*c*, 1620*d*, 1620*e*, etc., any one or more of which may be part of a set of related objects defined in accordance with the invention. These objects may comprise programs, methods, data stores, programmable logic, etc. The objects may comprise portions of the same or different devices such as PDAs, audio/video devices, MP3 players, personal computers, etc. Each object can communicate with another object by way of the communications network 1640. This network may itself comprise other computing objects and computing devices that provide services to the system of FIG. 16, and may itself represent multiple interconnected networks. In accordance with an aspect of the invention, each object 1610*a*, 1610*b*, etc. or 1620*a*, 1620*b*, 1620*c*, 1620*d*, 1620*e*, etc. may contain an application that might make use of an API, or other object, software, firmware and/or hardware, suitable for use with the object detection framework in accordance with the invention.

It can also be appreciated that an object, such as 1620*c*, may be hosted on another computing device 1610*a*, 1610*b*, etc. or 1620*a*, 1620*b*, 1620*c*, 1620*d*, 1620*e*, etc. Thus, although the physical environment depicted may show the connected devices as computers, such illustration is merely exemplary and the physical environment may alternatively be depicted or described comprising various digital devices such as PDAs, televisions, MP3 players, etc., any of which may employ a variety of wired and wireless services, software objects such as interfaces, COM objects, and the like.

There are a variety of systems, components, and network configurations that support distributed computing environments. For example, computing systems may be connected together by wired or wireless systems, by local networks or widely distributed networks. Currently, many of the networks are coupled to the Internet, which provides an infrastructure for widely distributed computing and encompasses many different networks. Any of the infrastructures may be used for exemplary communications made incident to network communications according to the present invention.

In home networking environments, there are at least four disparate network transport media that may each support a unique protocol, such as Power line, data (both wireless and wired), voice (e.g., telephone) and entertainment media. Most home control devices such as light switches and appliances may use power lines for connectivity. Data Services may enter the home as broadband (e.g., either DSL or Cable modem) and are accessible within the home using either wireless (e.g., HomeRF or 802.11x) or wired (e.g., Home PNA, Cat 5, Ethernet, even power line) connectivity. Voice traffic may enter the home either as wired (e.g., Cat 3) or wireless (e.g., cell phones) and may be distributed within the home using Cat 3 wiring. Entertainment media, or other graphical data, may enter the home either through satellite or cable and is typically distributed in the home using coaxial cable. IEEE 1394 and DVI are also digital interconnects for clusters of media devices. All of these network environments and others that may emerge, or already have emerged, as protocol standards may be interconnected to form a network, such as an intranet, that may be connected to the outside world by way of a wide area network, such as the Internet. In short, a variety of disparate sources exist for the storage and transmission of data, and consequently, any of the objects of the present invention may share and communicate data in any existing manner, and no one way described in the embodiments herein is intended to be limiting.

The Internet commonly refers to the collection of networks and gateways that utilize the Transmission Control Protocol/Internet Protocol (TCP/IP) suite of protocols, which are well-known in the art of computer networking. The Internet can be described as a system of geographically distributed remote computer networks interconnected by computers executing networking protocols that allow users to interact and share information over network(s). Because of such wide-spread information sharing, remote networks such as the Internet have thus far generally evolved into an open system with which developers can design software applications for performing specialized operations or services, essentially without restriction. Thus, it can be appreciated that virtually any response can be taken by an application or service based on disassociation event information received via the network.

Thus, the network infrastructure enables a host of network topologies such as client/server, peer-to-peer, or hybrid architectures. The "client" is a member of a class or group that uses the services of another class or group to which it is not related. Thus, in computing, a client is a process, i.e., roughly a set of instructions or tasks, that requests a service provided by another program. The client process utilizes the requested service without having to "know" any working details about the other program or the service itself. In a client/server architecture, particularly a networked system, a client is usually a computer that accesses shared network resources provided by another computer, e.g., a server. In the illustration of FIG. 16, as an example, computers 1620*a*, 1620*b*, 1620*c*, 1620*d*, 1620*e*, etc. can optionally be thought of as clients and computers 1610*a*, 1610*b*, etc. can optionally be thought of as servers where servers 1610*a*, 1610*b*, etc. maintain the data that is then replicated to client computers 1620*a*, 1620*b*, 1620*c*, 1620*d*, 1620*e*, etc., although any computer can be considered a client, a server, or both, depending on the circumstances. Any of these computing devices may be processing or otherwise responding to disassociation event data or requesting services or tasks that may implicate the object detection framework in accordance with the invention.

A server is typically a remote computer system accessible over a remote or local network, such as the Internet or wireless network infrastructures. The client process may be active in a first computer system, and the server process may be active in a second computer system, communicating with one another over a communications medium, thus providing distributed functionality and allowing multiple clients to take advantage of the information-gathering capabilities of the server. Any software objects utilized pursuant to a response to disassociation event information in accordance with the invention may be distributed across multiple computing devices or objects.

Client(s) and server(s) communicate with one another utilizing the functionality provided by protocol layer(s). For example, HyperText Transfer Protocol (HTTP) is a common protocol that is used in conjunction with the World Wide Web (WWW), or "the Web." Typically, a computer network address such as an Internet Protocol (IP) address or other reference such as a Universal Resource Locator (URL) can be used to identify the server or client computers to each other. The network address can be referred to as a URL address. Communication can be provided over a communications medium, e.g., client(s) and server(s) may be coupled to one another via TCP/IP connection(s) for high-capacity communication, such as may be demanded for real-time discovery of a disassociated object from a set of related objects.

Thus, FIG. 16 illustrates an exemplary networked or distributed environment, with server(s) in communication with client computer(s) via a network/bus, which may be implicated by the operation of one or more parts of the invention. In additional exemplary detail, a number of servers 1610*a*, 1610*b*, etc. are interconnected via a communications network/bus 1640, which may be a LAN, WAN, intranet, GSM network, satellite network, the Internet, etc., with a number of client or remote computing devices 1620*a*, 1620*b*, 1620*c*, 1620*d*, 1620*e*, etc., such as a portable computer, handheld computer, thin client, networked appliance, or other device, such as a VCR, TV, oven, light, heater or any object part of a set of related object defined in accordance with the present invention. It is thus contemplated that the present invention may apply to any object that can be networked, though for the avoidance of doubt, a networked capability is not required of any objects of a set of related objects defined in accordance with the invention.

In a network environment in which the communications network/bus 1640 is the Internet, for example, the servers 1610*a*, 1610*b*, etc. can be Web servers with which the clients 1620*a*, 1620*b*, 1620*c*, 1620*d*, 1620*e*, etc. communicate via any of a number of known protocols such as HTTP. Servers 1610*a*, 1610*b*, etc. may also serve as clients 1620*a*, 1620*b*, 1620*c*, 1620*d*, 1620*e*, etc., as may be characteristic of a distributed computing environment.

Where a networked capability exists for one of the objects, and it is further desirable to implement one or more aspects of responding to a disassociation event via a network, communications may be wired or wireless, or a combination, where appropriate. Client devices 1620*a*, 1620*b*, 1620*c*, 1620*d*, 1620*e*, etc. may or may not communicate via communications network/bus 1640, and may have independent communications associated therewith. Each client computer 1620*a*, 1620*b*, 1620*c*, 1620*d*, 1620*e*, etc. and server computer 1610*a*, 1610*b*, etc. may be equipped with various application program modules or objects 1635*a*, 1635*b*, 1635*c*, etc. and with connections or access to various types of storage elements or objects.

Any one or more of computers 1610*a*, 1610*b*, 1620*a*, 1620*b*, 1620*c*, 1620*d*, 1620*e*, etc. may be responsible for the maintenance and updating of a database 1630 or other storage element, such as a database or memory 1630 for storing disassociation event data processed or saved according to the invention. Thus, in various non-limiting embodiments, the present invention can be utilized in a computer network environment having client computers 1620*a*, 1620*b*, 1620*c*, 1620*d*, 1620*e*, etc. that can access and interact with a computer network/bus 1640 and server computers 1610*a*, 1610*b*, etc. that may interact with client computers 1620*a*, 1620*b*, 1620*c*, 1620*d*, 1620*e*, etc. and other like devices, and databases 1630.

Various implementations of the invention described herein may have aspects that are wholly in hardware, partly in hardware and partly in software, as well as in software. For any aspects of the invention that may be implemented in software, as described herein, there are multiple ways of implementing the present invention, e.g., an appropriate API, tool kit, driver code, operating system, control, standalone or downloadable software object, etc., which helps to enable one or more parts of the object detection framework of the invention.

The word "exemplary" is used herein to mean serving as an example, instance, or illustration. For the avoidance of doubt, the subject matter disclosed herein is not limited by such examples. In addition, any aspect or design described herein as "exemplary" is not necessarily to be construed as preferred or advantageous over other aspects or designs, nor is it meant to preclude equivalent exemplary structures and techniques known to those of ordinary skill in the art. Furthermore, to the extent that the terms "includes," "has," "contains," and other similar words are used in either the detailed description or the claims, for the avoidance of doubt, such terms are intended to be inclusive in a manner similar to the term "comprising" as an open transition word without precluding any additional or other elements.

As mentioned above, while exemplary embodiments of the present invention have been described in connection with various objects, markings for objects and network architectures, the underlying concepts may be applied to any objects for which it is desirable to group them according to relationships of the objects to detect separation. One of ordinary skill in the art will appreciate that there are numerous ways of providing object code and nomenclature that achieves the same, similar or equivalent functionality achieved by the various embodiments of the invention.

As mentioned, the various techniques described herein may be implemented in connection with hardware or software or, where appropriate, with a combination of both. As used herein, the terms "component," "system" and the like can refer to a computer-related entity, either hardware, a combination of hardware and software, software, or software in execution, though a component can be any. For example, a component may be, but is not limited to being, a process running on a processor, a processor, an object, an executable, a thread of execution, a program, and/or a computer. By way of illustration, both an application running on computer and the computer can be a component. One or more components may reside within a process and/or thread of execution and a component may be localized on one computer and/or distributed between two or more computers.

Thus, the methods and apparatus of the present invention, or certain aspects or portions thereof, may take the form of program code (i.e., instructions) embodied in tangible media, such as floppy diskettes, CD-ROMs, hard drives, or any other machine-readable storage medium, wherein, when the program code is loaded into and executed by a machine, such as a chip or a computer, the machine becomes an apparatus for practicing the invention. In the case of program code execution on programmable computers, or chips, the device generally includes a processor, a storage medium readable by the processor (including volatile and non-volatile memory and/or storage elements), at least one input device, and at least one output device. The program(s) can be implemented in assembly or machine language, if desired. In any case, the language may be a compiled or interpreted language, and combined with hardware implementations.

The methods and apparatus of the present invention may also be practiced via communications embodied in the form of program code that is transmitted over some transmission medium, such as over electrical wiring or cabling, through fiber optics, or via any other form of transmission, wherein, when the program code is received and loaded into and executed by a machine, such as an EPROM, a gate array, a programmable logic device (PLD), a client computer, etc., the machine becomes an apparatus for practicing the invention. When implemented on a general-purpose processor, the program code combines with the processor to provide a unique apparatus that operates to invoke the functionality of the present invention. Additionally, any storage techniques used in connection with the present invention may invariably be a combination of hardware and software.

Furthermore, the disclosed subject matter may be implemented as a system, method, apparatus, or article of manufacture using standard programming and/or engineering techniques to produce software, firmware, hardware, or any combination thereof to control a computer or microprocessor based device or chip, including nanotechnology chips, to implement aspects detailed herein. The term "article of manufacture" where used herein is intended to encompass a computer program accessible from any computer-readable device, carrier, or media. For example, computer readable media can include but are not limited to magnetic storage devices (e.g., hard disk, floppy disk, magnetic strips . . . ), optical disks (e.g., compact disk (CD), digital versatile disk (DVD) . . . ), smart cards, and flash memory devices (e.g., card, stick). Additionally, it is known that a carrier wave can be employed to carry computer-readable electronic data such as those used in transmitting and receiving electronic mail or in accessing a network such as the Internet or a local area network (LAN).

The aforementioned framework and systems have been described with respect to interaction between several components which are attached to or integrated with physical objects to form a set of related physical objects. It can be appreciated that such systems and components can include those components or specified sub-components, some of the specified components or sub-components, and/or additional components, and according to various permutations and combinations of the foregoing. As noted, sub-components can also be implemented as components communicatively coupled to other components rather than included within parent components (hierarchical). Additionally, it should be noted that one or more components may be combined into a single component providing aggregate functionality or divided into several separate sub-components, and any one or more middle layers, such as a management layer, may be provided to communicatively couple to such sub-components in order to provide integrated functionality. Any components described herein may also interact with one or more other components not specifically described herein but generally known by those of skill in the art.

In view of the exemplary systems described supra, methodologies that may be implemented in accordance with the disclosed subject matter will be better appreciated with reference to the flowcharts of FIGS. 3, 11, 12 and 13. While for purposes of simplicity of explanation, the methodologies are shown and described as a series of blocks, it is to be understood and appreciated that the claimed subject matter is not limited by the order of the blocks, as some blocks may occur in different orders and/or concurrently with other blocks from what is depicted and described herein. Where non-sequential, or branched, flow is illustrated via flowchart, it can be appreciated that various other branches, flow paths, and orders of the blocks, may be implemented which achieve the same or a similar result. Moreover, not all illustrated blocks may be required to implement the methodologies described hereinafter.

Furthermore, as will be appreciated various portions of the disclosed systems above and methods below may include or consist of artificial intelligence or knowledge or rule based components, sub-components, processes, means, methodologies, or mechanisms (e.g., support vector machines, neural networks, expert systems, Bayesian belief networks, fuzzy logic, data fusion engines, classifiers . . . ). Such components, inter alia, can automate certain mechanisms or processes performed thereby to make portions of the systems and methods more adaptive as well as efficient and intelligent.

While the present invention has been described in connection with the preferred embodiments of the various figures, it is to be understood that other similar embodiments may be used or modifications and additions may be made to the described embodiment for performing the same function of the present invention without deviating therefrom. Furthermore, it should be emphasized that where an object includes a networking capability in accordance with the invention, there are a variety of computer platforms, including handheld device operating systems and other application specific operating systems are contemplated, especially as the number of wireless networked devices continues to proliferate.

While exemplary embodiments may refer to utilizing the present invention in the context of particular programming language constructs, the invention is not so limited, but rather may be implemented in any language to provide methods for detecting disassociation of an object from a set of related objects in accordance with the invention. Still further, the present invention may be implemented in or across a plurality of processing chips or devices, and storage may similarly be effected across a plurality of devices. Therefore, the present invention should not be limited to any single embodiment, but rather should be construed in breadth and scope in accordance with the appended claims.

What is claimed is:

1. A method for detecting the disassociation of an object from a set of objects that are related independently of the location of the set, comprising:

receiving a definition of objects, wherein the objects are related independently of the location of the set and an object is designated as a parent object and the other objects are designated as child objects;

defining the child objects to be a child set of child objects for tracking a disassociation of a child object from other child objects in the child set;

defining the parent object and the child set to be a hierarchical set for tracking a disassociation of all the child objects from the parent object;

upon automatically detecting when a child object of the child set disassociates from the other child objects of the child set, signaling a disassociation within the child set, the detecting occurring when a child object exceeds a pre-defined proximity from another child object of the child set; and upon automatically detecting when all the child objects of the child set disassociates from the hierarchical set, signaling a disassociation within the hierarchical set, the detecting occurring when the parent object of the hierarchical set exceeds a pre-defined proximity from the child set.

2. The method of claim 1, further comprising:

generating at least one signal in response to said detecting.

3. The method of claim 2, wherein said generating includes, in response to said at least one signal, generating at least one of a sound, a lighting effect, a mechanical movement or a smell.

4. The method of claim 2, further comprising:

transmitting the at least one signal to an application or service via a communications network for further action based on the at least one signal.

5. A plurality of integrated circuit components comprising means for carrying out the method of claim 1.

6. An object detection framework for application to a plurality of related physical objects enabling detection of when a physical object of the plurality of related physical objects exceeds a pre-defined separation from the plurality of related physical objects, comprising:

a component that defines a child set of child objects for tracking a disassociation of a child object from other child objects in the child set;

a component that defines a hierarchical set of a parent object and the child set for tracking a disassociation of all the child objects from the parent object;

at least one detector component attached to at least one physical object of the set of related physical objects; and a plurality of emitter components, wherein at least one emitter component is attached to each of the physical objects of the set of related physical objects not having at least one detector component;

wherein the plurality of emitter components emit proximity information to the at least one detector component, and wherein the at least one detector component generates at least one disassociation event signal when the at least one detector component determines that the proximity information emitted from any of the plurality of emitter components indicates that the physical object to which the emitter component is attached exceeds a threshold proximity from the other physical objects of the set such that when a child object disassociates from the other child objects of the child set the disassociate event signal indicates a disassociation within the child set and when all the child objects of the child set disassociate from the parent object, the disassociate event signal indicates a disassociation within the hierarchical set.

7. The framework of claim 6, further comprising:

at least one transmitter component communicatively coupled to the at least one detector component for transmitting the at least one disassociation event signal to at least one application or service via a network.

8. The framework of claim 6, wherein the plurality of emitter components emit detection information to the at least one detector object via electronic, chemical or biological signals.

9. The framework of claim 6, further comprising:

at least one responder component communicatively coupled to the at least one detector component for initiating a sensory alert in response to the at least one disassociation event signal, wherein the sensory alert includes at least one of a sound, a light, a smell or a vibration.

10. The framework of claim 6, wherein the plurality of emitter components include any of a radio frequency identification (RFID) chip, a wireless communications integrated circuit, a biological composition, or a chemical composition.

11. The framework of claim 6, wherein the at least one detector component includes any of a radio frequency identification (RFID) transponder, a wireless communications integrated circuit, a biological composition detector, or a chemical composition detector.

12. A method for detecting the disassociation of an object from a set of related objects, comprising:

defining a child set of child objects independent of physical location of the child set by applying at least one of an emitter object and a detector object on each of the child objects of the child set;

defining a hierarchical set of a parent object and the child set by applying at least one of an emitter object and a detector object on the parent object;

upon automatically detecting when a child object of the child set disassociates from the other child objects of the child set, signaling a disassociation within the child set; and upon automatically detecting when all of the child objects of the child set disassociate from the parent object, signaling a disassociation within the hierarchical set.

13. The method of claim 12, wherein said defining includes defining structural information about the object relationships in the set.

14. The method of claim 13, wherein the child objects are related equally.

15. The method of claim 13, wherein a child object of the child set has a priority.

16. The method of claim 13, further comprising, generating a notification to a user near the parent object to notify the user of the disassociation.

17. A system including a plurality of markers and a detector comprising means for carrying out the method of claim 12.

18. The method of claim 1 wherein the signaling of the disassociation within the child set occurs when a threshold number of child objects become disassociated from the child set.

19. The method of claim 12 wherein the signaling of the disassociation within the child set occurs when a threshold number of child objects become disassociated from the child set.

* * * * *

UNITED STATES PATENT AND TRADEMARK OFFICE

CERTIFICATE OF CORRECTION

PATENT NO. : 7,817,038 B2
APPLICATION NO. : 11/625548
DATED : October 19, 2010
INVENTOR(S) : Kristian Torning It is certified that error appears in the above-identified patent and that said Letters Patent is hereby corrected as shown below:

In column 18, line 43, in Claim 1, delete "disassociates" and insert -- disassociate --, therefor.

Signed and Sealed this
Eighth Day of February, 2011

David J. Kappos

David J. Kappos
*Director of the United States Patent and Trademark Office*